US009542786B2

(12) United States Patent
Enomoto

(10) Patent No.: US 9,542,786 B2
(45) Date of Patent: Jan. 10, 2017

(54) COIN HOPPER

(71) Applicant: Asahi Seiko Co., Ltd., Tokyo (JP)

(72) Inventor: Minoru Enomoto, Saitama (JP)

(73) Assignee: ASAHI SEIKO CO., LTD. (JP)

( * ) Notice: Subject to any disclaimer, the term of this patent is extended or adjusted under 35 U.S.C. 154(b) by 0 days.

(21) Appl. No.: 15/164,596

(22) Filed: May 25, 2016

(65) Prior Publication Data

US 2016/0364933 A1 Dec. 15, 2016

(30) Foreign Application Priority Data

Jun. 9, 2015 (JP) ..... 2015-116939

(51) Int. Cl.
*G07D 1/00* (2006.01)
*G07D 3/06* (2006.01)
*G07D 11/00* (2006.01)

(52) U.S. Cl.
CPC *G07D 3/06* (2013.01); *G07D 1/00* (2013.01); *G07D 11/0003* (2013.01)

(58) Field of Classification Search
CPC .. G07D 1/00; G07D 11/0003; G07D 2201/00; G07D 3/06
USPC ..... 453/57
See application file for complete search history.

(56) References Cited

U.S. PATENT DOCUMENTS

| | | | | |
|---|---|---|---|---|
| 1,813,296 | A * | 7/1931 | Kidwell | G07D 3/06 453/12 |
| 6,976,589 | B2 * | 12/2005 | De Raedt | G07D 3/14 209/552 |
| 8,408,979 | B2 | 4/2013 | Abe et al. | |
| 8,430,224 | B2 | 4/2013 | Abe et al. | |
| 8,439,731 | B2 | 5/2013 | Umeda | |
| 8,734,208 | B2 | 5/2014 | Abe et al. | |
| 8,776,993 | B2 | 7/2014 | Umeda | |
| 8,960,413 | B2 | 2/2015 | Umeda | |
| 9,202,325 | B2 | 12/2015 | Umeda | |
| 2006/0019591 | A1 * | 1/2006 | Abe | G07D 3/02 453/18 |

* cited by examiner

*Primary Examiner* — Mark Beauchaine

(57) ABSTRACT

A coin hopper includes a rotating disc having recesses that receive and hold coins one by one; a moving body that is disposed at a position corresponding to the recess and moves reciprocally between a holding position and a push-out position; a cam groove including a first route having a substantially circular shape and a second route connected to the first route at first and second branch points and protruding toward the outer periphery of the rotating disc with respect to the first route; and a cam follower disposed in the cam groove provided on a back side of the moving body. The moving body is held at the holding position when the cam follower moves along the first route and moves reciprocally between the holding position and the push-out position when the cam follower moves along the second route.

5 Claims, 17 Drawing Sheets

COIN HOPPER

CROSS-REFERENCE TO RELATED APPLICATION

The present application claims priority from Japanese Patent Application No. JP 2015-116939 filed Jun. 9, 2015.

BACKGROUND OF THE INVENTION

1. Field of the Invention

The present invention relates to a coin dispensing apparatus that separates coins loaded in bulk one by one, in to a coin dispensing apparatus that separates coins loaded in bulk one by one, conveys the separated coins to a predetermined position and discharges the coins at the predetermined position individually. More specifically, the invention relates to a coin hopper suitably used when handling a plurality of kinds of coins different at least in outer diameter.

The term "coins" used in this specification includes coins as currencies, medals for game machines, substitutes such as tokens, and equivalents thereof.

2. Description of the Related Art

A plurality of kinds of coins that are different in outer diameter or thickness exist, and thus various kinds of so-called size-free coin handling apparatuses capable of handling the plurality of kinds of coins (that is, a plurality of coin denominations) are proposed. For example, the Japanese Non-Examined Patent Publication No. 2014-041396 (FIGS. 3 to 15, Paragraphs 0024 to 0044) and the Japanese Non-Examined Patent Publication No. 2014-120015 (FIG. 2, FIGS. 10 to 17, Paragraphs 0022 to 0040, 0076) disclose coin dispensing apparatuses that separate coins loaded in bulk one by one and deliver the coins individually.

Known as a first related art is a coin separating and delivering device such as that disclosed in the Publication No. 2014-041396. In this coin separating and delivering apparatus, coins are separated and held one by one on an upper surface of a rotating disc disposed in an inclined state in sorting recesses opening on an upper side and on a peripheral edge side thereof, and are delivered to a coin discriminating device. The sorting recesses each include a sorting recessed groove extending from a center to an outer periphery of the rotating disc, and a peripheral side opening and an upper surface side opening defined by a moving body. The moving body is disposed in the sorting recessed groove so as to make a linear reciprocal motion between a sorting position at a bottom portion in the sorting recessed groove and a coin push-out position on the peripheral edge side of the rotating disc. The moving body includes a pushing edge facing the peripheral side opening, and forms a holding recess surrounded by a left side wall and a right side wall of the sorting recess and an arcuate restricting member that surrounds an outer periphery of the rotating disc. The holding recess is formed to allow a single coin having the largest diameter to be positioned therein but not to allow two coins having the smallest diameter to be positioned side by side when the moving body is located at the sorting position. The moving body is driven by a driving device so as to move linearly toward the coin push-out position on the peripheral edge side in a predetermined phase of the rotating disc, then stay at the coin push-out position for a predetermined period, and then move linearly to the sorting position. The driving device includes a plate-shaped cam having a ring shape and disposed on the rotating disc in a fixed manner, and a pair of cam followers positioned inside and outside of the plate-shaped cam integrally with the moving body.

According to the coin separating and delivering device disclosed in the Publication No. 2014-041396, when the rotating disc rotates in a forward rotating direction, the moving body moves linearly from the sorting position toward the coin push-out position in a predetermined phase of the rotating disc, is maintained at the coin push-out position for the predetermined period, and then moves from the coin push-out position to the sorting position. In contrast, in the same manner as the case where the rotating disc rotates in a reverse rotating direction, which is a direction opposite to the forward rotating direction, the moving body moves from the sorting position to the coin push-out position, is maintained at the coin push-out position for the predetermined period, and moves from the coin push-out position to the sorting position. In other words, the moving body moves reciprocally in a predetermined phase range of the rotating disc, in other words, in a phase where the coin is delivered from the coin separating and delivering device to the next process between the sorting position and the coin push-out position irrespective of the rotating direction of the rotating disc.

In the coin separating and delivering device disclosed in the Publication No. 2014-041396, if coin jam occurs in the next process where the coins are delivered, the rotating disc rotates reversely to return the coins from the next process to the separating and delivering device in order to resolve the coin jam. However, the moving body moves reciprocally between the sorting position and the coin push-out position in a predetermined phase range irrespective of the rotating direction of the rotating disc. Therefore, even in the process of returning the coin, a coin is pushed out from the rotating disc to the next process in association with the movement of the moving body from the sorting position toward the coin push-out position. Consequently, since the conveyance of the coin back from the next process to the rotating disc is hindered by the coin pushed out from the rotating disc, a problem that the coin jam is not resolved remains.

A second related art is a coin hopper disclosed in the Publication No. 2014-120015. This coin hopper includes a sorting panel disposed in a bottom hole of a storage chamber where coins are stored in bulk and having circular through holes formed therein. The coins are dropped down from an upside through the through holes by a rotation of the sorting panel, and pushing bodies provided on a back side of the sorting panel push coins in a direction toward a circumference of the sorting panel at a predetermined position one by one. A coin holding plate having substantially the same diameter as the sorting panel is disposed below the sorting panel at a predetermined distance therefrom. The coin holding plate is disposed coaxially with and parallel to the sorting panel to form a coin holding space. The sorting panel is also provided with passages extending toward a circumference thereof which are formed on the back side thereof, continue to the coin holding space, and extend in the direction toward the circumference of the sorting panel. The passages extending to the circumference are each defined by a front guide member positioned in front of the sorting panel and a rear guide member positioned in the rear of the sorting panel in a direction of the forward rotation. When the sorting panel rotates in the forward rotating direction, the pushing bodies are each movable at a predetermined timing between a coin push-out position located in the coin holding space right below the corresponding through hole and a waiting position located on an axis of rotation side of the sorting panel laterally of the through hole and hidden under the sorting panel. The pushing bodies each move gradually from the waiting position toward the coin push-out position, reach the coin push-out position at a position corresponding to the predetermined position, and move gradually toward the waiting position after the arrival to the coin push-out position, so that the coins are moved from the through holes toward the circumference of the sorting panel through the passages extending to the circumference thereof.

The coin hopper disclosed in the Publication No. 2014-120015 is configured to allow the pushing body to move between the waiting position and the coin push-out position at a predetermined timing when the sorting panel rotates in the forward rotating direction. Specifically, the pushing body moves from the waiting position to the coin push-out position, pushes the coin held in the coin holding space from the sorting panel, and then moves from the coin push-out position to the waiting position at a predetermined timing. In contrast, when the sorting panel rotates reversely, the pushing body is held at the waiting position in a range where the pushing body moves between the waiting position and the coin push-out position when the sorting panel rotates in the forward rotating direction. A cam is disposed under the sorting panel, and the cam followers guided by the cam are fixed to the pushing bodies. The cam includes the cam followers, a groove cam that guides the cam followers when the sorting panel rotates in the forward rotating direction, and a reverse rotation groove cam that is branched from the groove cam and guides the cam followers when the sorting panel rotates in the reverse direction. The reverse rotation groove cam has an end on a downstream side in the reverse rotating direction of the sorting panel. Accordingly, when the sorting panel is rotated reversely, the cam follower reaches the end of the reverse rotation groove cam after a predetermined time period has elapsed, and the reverse rotation of the sorting panel is hindered. Therefore, even though the sorting panel is rotated reversely in order to resolve, for example, coin jam occurred in the coin hopper or in the next process of the coin hopper, the period of the reverse rotation of the sorting panel is short, and thus the problem that the coin jam is not resolved remains.

SUMMARY OF THE INVENTION

In order to solve the problem described above, it is an object of the invention to provide a coin hopper having a function to resolve abnormalities such as coin jam with a simple configuration. Other objects of the invention which are not described explicitly here will be apparent from a description given below and appended drawings.

(1) In order to achieve the above-described object, a coin hopper according to a first aspect of the invention is a coin hopper that separates coins in bulk one by one and delivers the coins individually including: a rotating disc that is selectively rotatable in a first rotating direction and a second rotating direction, which is a direction opposite to the first rotating direction; a recess that is formed on a surface of the rotating disc, extends from a central portion of the rotating disc toward an outer periphery of the rotating disc, opens at an outer peripheral end of the rotating disc, and receives and holds one of the coins; a moving body that is disposed at a position corresponding to the recess, the moving body moving reciprocally between a coin holding position, which corresponds to a central portion of the rotating disc, for forming a bottom portion of the recess and receives the coin in cooperation with the recess and a coin push-out position, which corresponds to a position moved toward the outer periphery of the rotating disc, for pushing out the coin held in the recess toward the outer periphery of the rotating disc; a cam wheel disposed on a back side of the rotating disc and provided with a cam groove having a predetermined shape on the rotating disc side; and a cam follower disposed in the cam groove provided on a back side of the moving body, wherein the cam groove includes a first route having a substantially circular shape and a second route connected to the first route at first and second branch points and protruding toward the outer periphery of the rotating disc with respect to the first route, the moving body is held at the coin holding position when the cam follower moves along the first route and moves reciprocally between the coin holding position and the coin push-out position when the cam follower moves along the second route, and a route switching device is provided at the first branch point, and causes a moving route of the cam follower to be switched from the first route to the second route when the rotating disc rotates in the first rotating direction and the moving route of the cam follower to be maintained in the first route when the rotating disc rotates in the second rotating direction.

The coin hopper according to the first aspect of the invention includes: a rotating disc that is selectively rotatable in a first rotating direction (forward rotating direction) and a second rotating direction (reverse rotating direction) which is a direction opposite to the first rotating direction (forward rotating direction); a recess that is formed on a surface of the rotating disc and receives and holds one of coins therein; a moving body disposed at a position corresponding to the recess; a cam wheel disposed on a back side of the rotating disc and provided with a cam groove; and a cam follower provided on the back surface of the moving body and disposed in the cam groove.

The recess receives one of the coins with a plane surface of the coin in surface contact with the bottom surface thereof. The moving body is reciprocally movable between the coin holding position at which the moving body is positioned at the central portion of the rotating disc and forms the bottom portion of the recess and the push-out position on an outer peripheral side of the rotating disc. Accordingly, when the moving body is located at the coin holding position, the moving body receives the coin in cooperation with the recess. When the moving body moves from the coin holding position toward the coin push-out position, the moving body pushes out the coin held in the recess toward the outer periphery of the rotating disc.

The cam groove includes the first route having a substantially circular shape and the second route connected to the first route at the first and second branch points and protruding toward the outer periphery side of the rotating disc with respect to the first route. The route switching device that switches the moving route of the cam follower is provided at the first branch point. The route switching device causes the moving route of the cam follower to be switched from the first route to the second route when the rotating disc rotates in the first rotating direction (forward rotating direction), while the moving route of the cam follower to be maintained in the first route when the rotating disc rotates in the second rotating direction (reverse rotating direction). Accordingly, when the rotating disc rotates in the first rotating direction (forward rotating direction), the moving body starts moving from the coin holding position toward the coin push-out position at the first branch point, and thus the coin held in the recess is pushed out toward the outer periphery of the rotating disc. In contrast, when the rotating disc rotates in the second rotating direction (reverse rotating direction), the moving body is maintained at the coin holding position, and thus the coin held in the recess is not pushed out toward the outer periphery of the rotating disc and the rotating disc rotates in the second rotating direction (reverse rotating direction). Therefore, abnormalities such as coin jam are resolved with a simple configuration.

(2) According to a preferable example of the coin hopper of the invention, the route switching device includes a rotating shaft extending perpendicularly to a bottom surface of the cam groove and a valve element disposed rotatably about the rotating shaft, the valve element is switchable between a first position for blocking the first route and communicating the first route with the second route, and a second position for blocking the communication between the first route and the second route and opening the first route, and the valve element is pushed from the first position toward the second position by the cam follower when the rotating disc rotates in the second rotating direction.

The route switching device includes the valve element disposed rotatably about the axis of rotation extending perpendicularly to the bottom surface of the cam groove. The valve element is switchable between the first position for blocking the first route and communicating the first route with the second route and the second position to open the first route. The valve element is pushed from the first position toward the second position by the cam follower when the rotating disc rotates in the second rotating direction (reverse rotating direction). Accordingly, the first route is released from the state of being blocked by the route switching device, and thus the moving route of the cam follower is maintained to the first route. Therefore, abnormalities such as coin jam are resolved with a simple configuration.

(3) According to another preferable example of the coin hopper of the invention, the valve element turns from the second position toward the first position under its own weight.

The route switching device does not require a drive force from a drive source such as a motor and a solenoid. Therefore, the movement of the cam follower is not hindered by a failure of the drive source, and application of an excessive load to a driving device of the rotating disc is prevented.

(4) According to another preferable example of the coin hopper of the invention, the valve element is urged by an urging member from the second position toward the first position.

The route switching device does not require a drive force from the drive source such as a motor and a solenoid. Therefore, the movement of the cam follower is not hindered by a failure of the drive source, and application of an excessive load to the driving device of the rotating disc is prevented.

(5) According to a preferable example of the coin hopper of the invention, the route switching device is elastically advanceable and retractable with respect to the first route and includes an inclined surface having a predetermined angle with respect to a bottom surface of the first route and inclined toward a downstream side of the first rotating direction, and the route switching device is retracted from the first route by being pushed on the inclined surface by the cam follower when the rotating disc rotates in the second rotating direction.

The route switching device is advanceable and retractable with respect to the first route of the cam groove, and includes the inclined surface inclined toward the downstream side of the first rotating direction of the rotating disc on an upper surface thereof. When the rotating disc rotates in the second rotating direction (reverse rotating direction), the inclined surface is pushed out by the cam follower, and the route switching device is retracted from the first route. Accordingly, the first route is released from the state of being blocked by the route switching device, and thus the moving route of the cam follower is maintained to the first route. Therefore, abnormalities such as coin jam are resolved with a simple configuration.

The route switching device does not require a drive force from the drive source such as a motor and a solenoid. Therefore, the movement of the cam follower is not hindered by a failure of the drive source, and application of an excessive load to the driving device of the rotating disc is prevented.

A coin dispensing apparatus achieves advantageous effects such that (a) a plurality of kinds of coins different in outer diameter and thickness may be separated one by one and delivered individually, and (b) abnormalities such as coin jam are resolved with a simple configuration.

DESCRIPTION OF THE PREFERRED EMBODIMENTS

Embodiments of the invention will be described below with reference to the attached drawings.

First Embodiment

Figure 1:
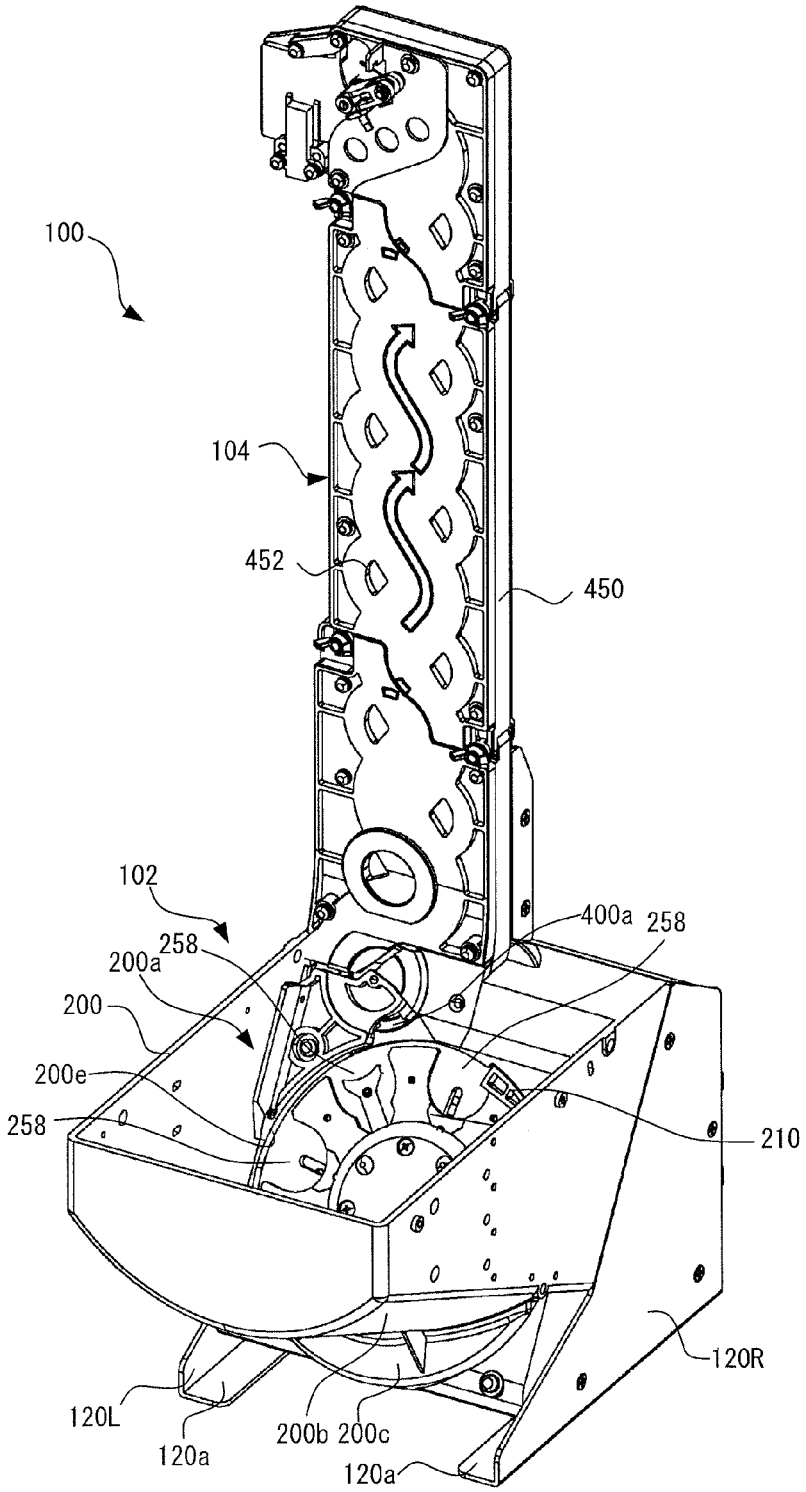
FIG. 1 is a perspective view illustrating a coin conveying and dispensing apparatus of a first embodiment of the invention.
Figure 2:
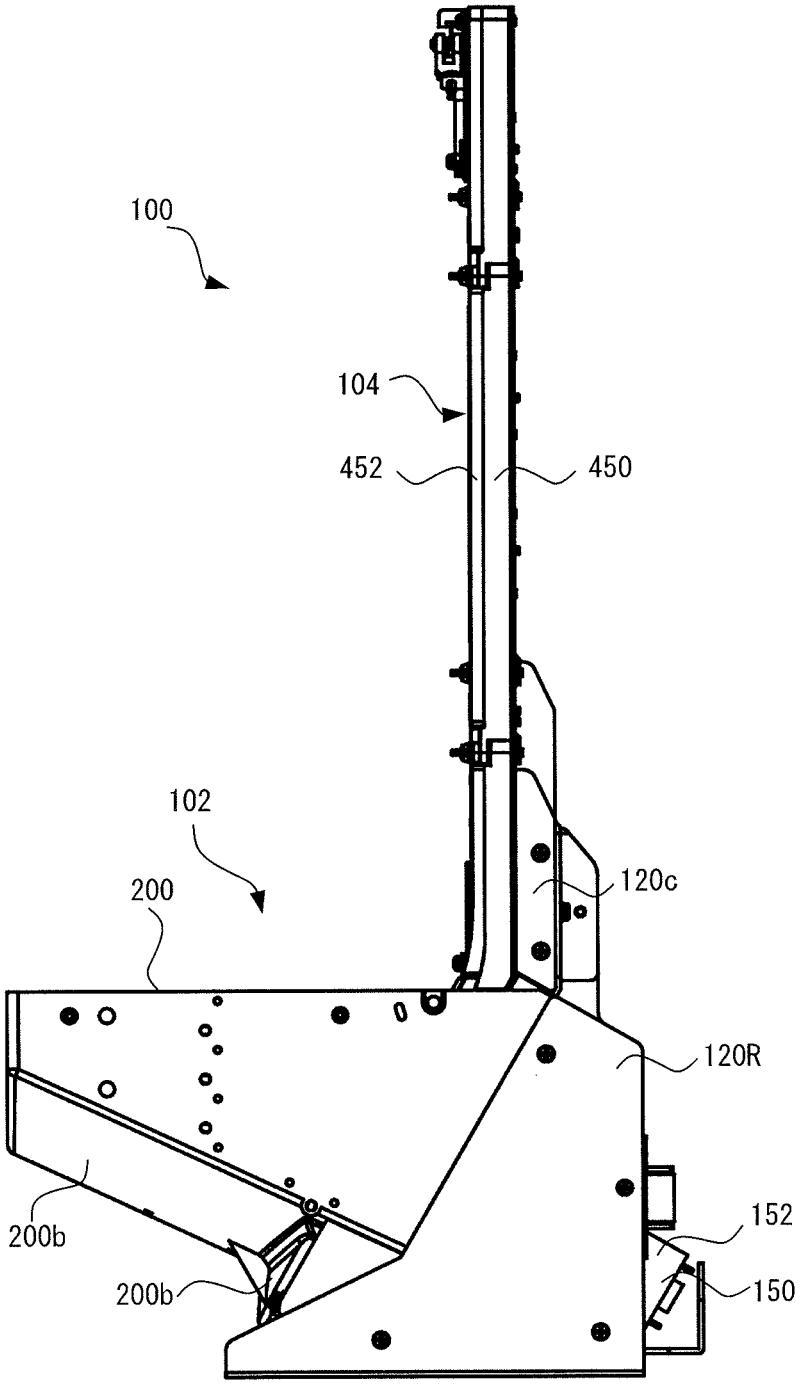
FIG. 2 is a right side view illustrating the coin conveying and dispensing apparatus of the first embodiment of the invention.
Figure 3:
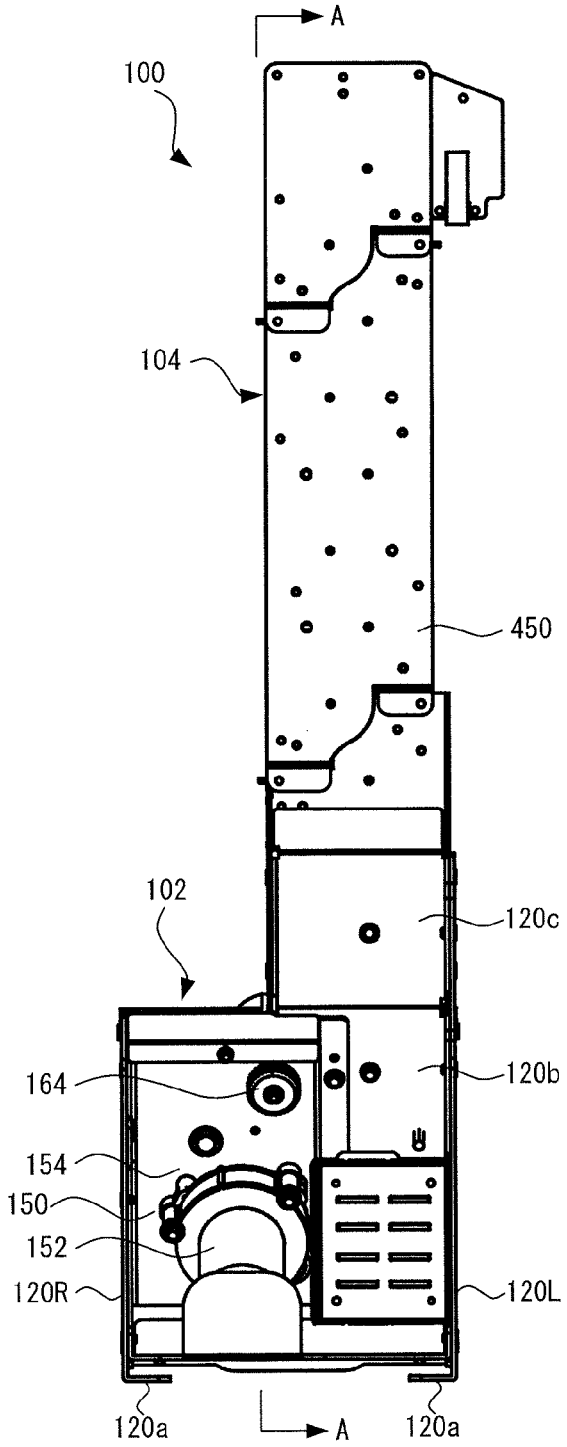
FIG. 3 is a back view illustrating the coin conveying and dispensing apparatus of the first embodiment of the invention.
Figure 4:
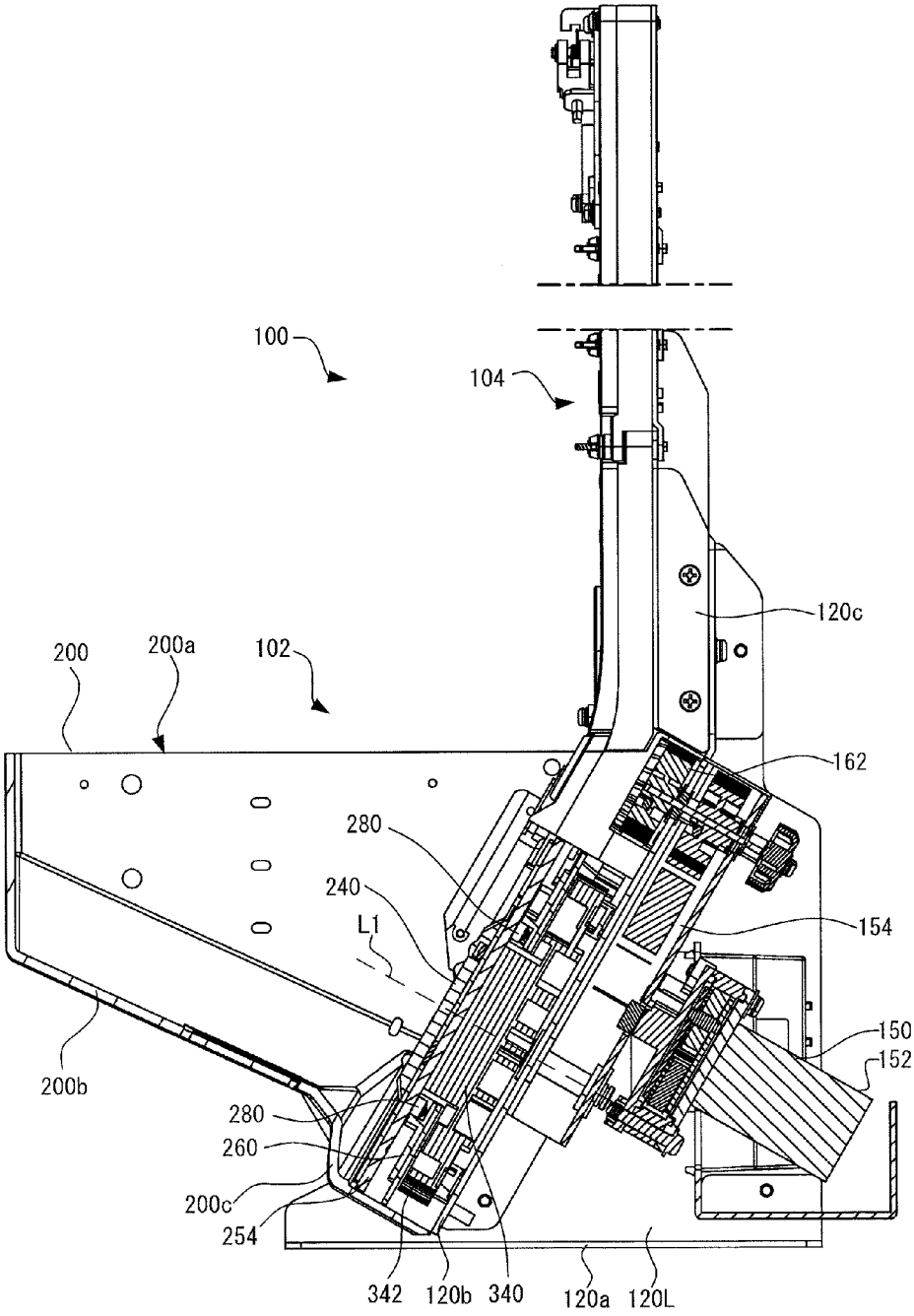
FIG. 4 is a cross-sectional view of the coin conveying and dispensing apparatus in FIG. 3 taken along a line A-A in FIG. 3.

FIG. 1, FIG. 2, and FIG. 3 illustrate a coin conveying and dispensing apparatus 100 of a first embodiment of the invention. The coin conveying and dispensing apparatus 100 functions to separate a plurality of kinds of coins loaded in bulk and different in outer diameter and thickness one by one and convey the separated coins, and includes a coin hopper 102 and a coin conveying apparatus 104. The coin hopper 102 functions to separate the coins loaded in bulk one by one and deliver the coins to a next process (the coin conveying apparatus 104 in the first embodiment). The coin conveying apparatus 104 functions to receive the coins delivered from the coin hopper 102, convey the received coins to predetermined dispensing positions and dispense the conveyed coins one by one. The coin conveying apparatus 104 used here may be, for example, a coin conveying apparatus disclosed in the Japanese Patent No. 5732640.

Coin Hopper

The coin hopper 102 will be described with reference to FIG. 1 to FIG. 14B. The coin hopper 102 functions to separate coins C in bulk one by one and deliver the coins C to the coin conveying apparatus 104 in a next process. The coin hopper 102 includes a coin tank 200 in which a number of coins C are stored, a mounting base 120 that supports and fixes the coin tank 200, a rotating disc 240 that sorts the coins C one by one, and a driving device 150 that drives the rotating disc 240.

Coin Tank

The coin tank 200 will be described with reference to FIG. 1 to FIG. 6. The coin tank 200 functions to store a number of coins C in bulk and deliver the coins toward the rotating disc 240. The coin tank 200 includes an insertion port 200*a* that opens upward to allow loading of the coins C therein, a bottom wall 200*b* inclined toward the mounting base 120, more specifically, toward the rotating disc 240, a rear wall 200*c* that guides the coins C to the rotating disc 240 at an inclined lower end portion of the bottom wall 200*b*, and a supply port 200*d* that opens toward the rotating disc 240 to supply the coins C to the rotating disc 240.

An inclination of the bottom wall 200*b* has an angle that allows the coins to slip toward the rotating disc 240 under their own weight. The rear wall 200*c* functions to render the coins C slipped along the bottom wall 200*b* upright. The rear wall 200*c* faces the rotating disc 240 with the supply port 200*d* interposed therebetween. A distance between an upper end portion of the rear wall 200*c* and a surface of the rotating disc 240 is set to be smaller than diameters of the coins C, and a distance between a lower end portion of the rear wall 200*c* and the surface of the rotating disc 240 is set to be larger than thicknesses of the coins C. Accordingly, when the coin C is upright, the surface of the coin C and the surface of the rotating disc 240 face each other and thus the coins C engage coin holding portions 258 of the rotating disc 240, which will be described later, respectively, and all of the coins are dispensed without leaving even one coin behind. The supply port 200*d* is formed into a substantially hollow cylindrical shape, and a hollow portion thereof has a diameter larger than a diameter of a disc body 254 of the rotating disc 240. An inner peripheral surface of the supply port 200*d* faces an outer peripheral end of the disc body 254 of the rotating disc 240.

Mounting Base

The mounting base 120 will be described with reference to FIG. 1 to FIG. 5. The mounting base 120 functions to rotatably support the rotating disc 240 and to allow fixation of, for example, the coin tank 200 thereto. The mounting base 120 includes a pair of horizontal placing base portions 120*a*, a first mounting portion 120*b* inclined with respect to the placing base portions 120*a*, a second mounting portion 120*c* extending vertically upward from an upper end of the first mounting portion 120*b*, and supporting side walls 120L and 120R extending upright at a substantially right angle with respect to the placing base portions 120*a*. The placing base portions 120*a* have a rectangular flat plate shape and are formed integrally with the supporting side walls 120L and 120R. The first mounting portion 120*b* has a flat plate shape, and inclines at an angle of approximately 60 degrees with respect to the placing base portions 120*a*. The rotating disc 240 is disposed on an upper surface 120U side of the first mounting portion 120*b*, and a driving device 150 is mounted on a back side thereof. An angle of inclination of the first mounting portion 120*b* is preferably included in a range from 50 degrees to 70 degrees. If the angle of inclination is smaller than 50 degrees, an amount of storage of the coins C is reduced, and if the angle of inclination is larger than 70 degrees, the coins C may fall easily from individual coin holding portions 258, which will be described later. The second mounting portion 120*c* is formed integrally with the first mounting portion 120*b* and supports the coin conveying apparatus 104.

Rotating Disc

The rotating disc 240 will be described with reference to FIG. 4 to FIG. 14B. The rotating disc 240 functions to separate a plurality of kinds of coins C different in outer diameter and thickness and loaded in bulk in the coin tank 200 one by one and convey the separated coins toward the coin conveying apparatus 104. The rotating disc 240 includes a driven gear 340 rotatable about an axis of rotation L1 that is perpendicular to a surface of the first mounting portion 120*b* of the mounting base 120, and the disc body 254 fixed to the driven gear 340. The disc body 254 has a center located on the axis of rotation L1. In other words, the driven gear 340 and the disc body 254 are coaxially disposed. A stirring member, which is not illustrated, is provided on a front surface side of the disc body 254. The stirring member is configured to rotate together with the rotating disc 240, and functions to stir the coins C stored in the coin tank 200.

The driven gear 340 includes a cylindrical gear portion 342 having a predetermined diameter, and a cylindrical projecting portion 346 having a diameter smaller than a diameter of the gear portion 342. The gear portion 342 and the projecting portion 346 are disposed with center axes thereof aligned coaxially, and are formed integrally, so that a cross-sectional side view of the driven gear 340 has a convex shape. The gear portion 342 is provided with teeth having a predetermined pitch on a column-shaped peripheral surface, and is coupled to and driven by the driving device 150, which will be described later.

The disc body 254 is fixed to the projecting portion 346 of the driven gear 340 so as to be coaxial with the driven gear 340. The disc body 254 is provided with a plurality of the coin holding portions 258 that hold the coins C one by one on a surface thereof. All of the individual coin holding portions 258 have the same structure and the same function. Therefore, the same reference numerals are allocated to the components that constitute the individual coin holding portions 258, and basically, one of the coin holding portions 258 may be described below collectively as a representative. Each coin holding portion 258 includes a recess 244, a moving body 242 disposed at a position corresponding to the recess 244, and a cam follower 280 fixed to the moving body 242.

Figure 5:
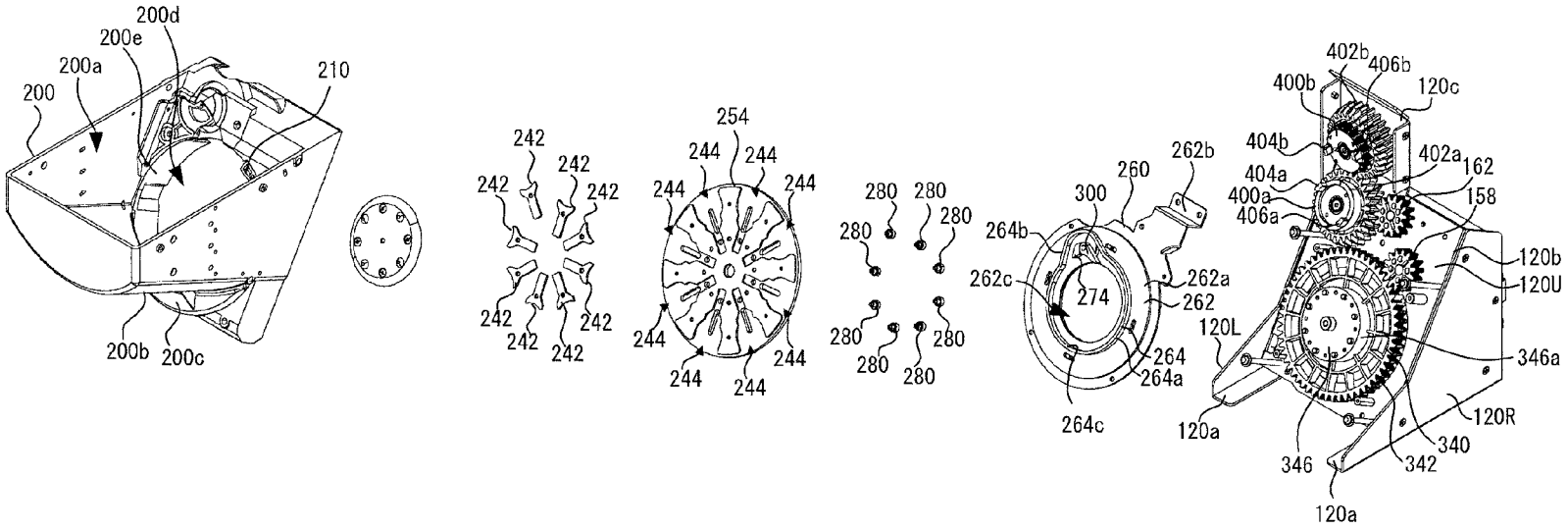
FIG. 5 is an exploded perspective view illustrating a coin hopper of the coin conveying and dispensing apparatus of the first embodiment of the invention.

Each recess 244 is opened to the front surface side and the outer peripheral end of the disc body 254, and is formed into a substantially U-shape extending from the outer peripheral end of the disc body 254 toward a center of the disc body 254 (that is, the axis of rotation L1), see FIG. 5. The recesses 244 are disposed radially on the surface of the disc body 254 at regular intervals. Each opening of the recess 244 on the outer peripheral end side of the disc body 254 faces an inner peripheral surface 200*e* of the supply port 200*d* of the coin tank 200 in a range of an angle θ1 from a straight line L2 to a straight line L3 and a range of an angle θ2*c* from the straight line L3 to a straight line L5 from a direction of 0 o'clock of a cam device 260, which will be described later, clockwise (a reverse rotating direction D2 of the rotating disc 240) in a state illustrated in FIGS. 9A and 9B.

Each recess 244 includes a holding surface 256 that supports one side of a coin C, a side wall 248 on an upstream side and a side wall 250 on a downstream side in a forward rotating direction D1 of the rotating disc 240. Each holding surface 256 functions to hold the coin C by contacting with the one side of the coin C. Each holding surface 256 inclines with respect to the horizontal plane by approximately 60 degrees. In other words, each holding surface 256 is disposed in substantially parallel to the upper surface 120U of the first mounting portion 120*b* of the mounting base 120.

Each holding surface 256 is provided with a guide hole 246 extending along a direction of the diameter of the disc body 254. Each follower pin 282 is inserted into each guide hole 246. Each follower pin 282 is guided by each guide hole 246, and is movable along the direction of the diameter of the disc body 254. Each follower pin 282 moves in a direction of rotation of the disc body 254 in association with the rotation of the disc body 254, and is reciprocally movable in each guide hole 246 in accordance with the cam device 260, which will be described later.

The plate-shaped moving body 242 is disposed on each recess 244. Each moving body 242 is formed into a substantially Y-shape, and is disposed in parallel to the holding surface 256. Each moving body 242 is reciprocally movable between a coin holding position P3 on a bottom portion (the axis of rotation L1) side of each recess 244 and a push-out position P4 on an outer peripheral side of the disc body 254. Each moving body 242 is fixed by one end of each follower pin 282. Accordingly, each moving body 242 moves together with each follower pin 282 between the coin holding position P3 and the coin push-out position P4 along a direction of extension of each guide hole 246.

Each moving body 242 includes a pushing surface 252 that pushes a peripheral surface of a coin C held in each recess 244 at a distal end thereof. Each pushing surface 252 is curved to be substantially flush with each side wall 248 and each side wall 250 when each moving body 242 takes the coin holding position P3. More specifically, each pushing surface 252 is determined to substantially match the peripheral surface of a coin having the largest diameter among coins C that are assumed to be used. Accordingly, the peripheral surface of the coin C is stably supported by each pushing surface 252. Each pushing surface 252 needs only be capable of supporting stably the peripheral surface of a coin C and thus may be formed into a V-shape. If each pushing surface 252 is formed into the V-shape, a coin C is held in the V-shaped recess, and both surfaces of the V-shape may stably support the peripheral surface of the coin C.

Each cam follower 280 is disposed on the back side of the disc body 254, and is fixed to each follower pin 282. In other words, each moving body 242 and each cam follower 280 are coupled by each follower pin 282 that penetrates through each corresponding guide hole 246. Each cam follower 280 follows a cam groove 266 provided on a cam wheel 262, which will be described later, in association with a rotation of the disc body 254, that is, a rotation of the rotating disc 240. Accordingly, each moving body 242 is reciprocally movable between the coin holding position P3 and the coin push-out position P4 in association with each corresponding cam follower 280 that follows the cam groove 266.

Figure 8:
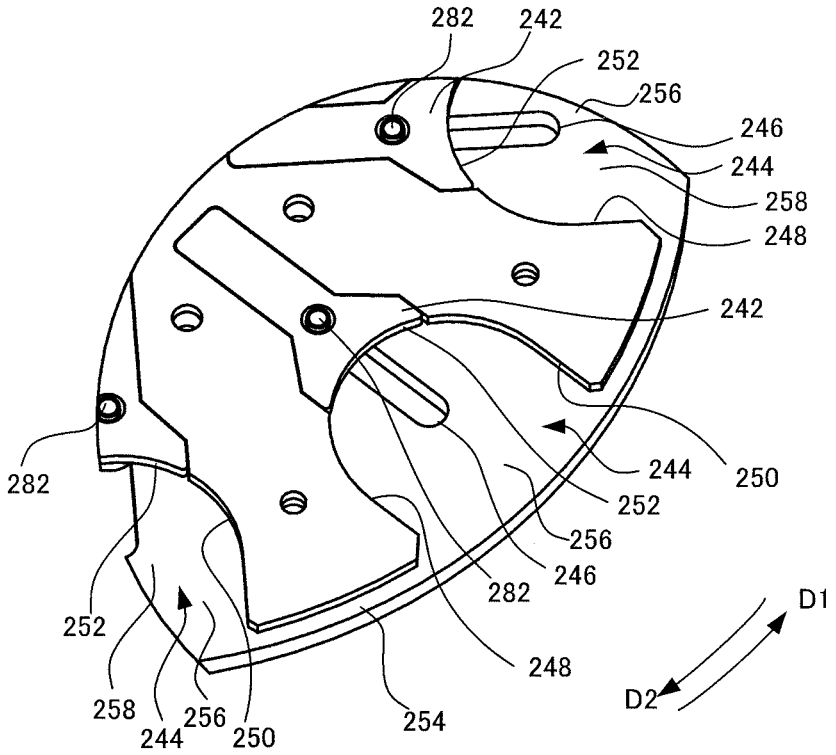
FIG. 8 is a perspective view illustrating a coin holding portion of a coin hopper of the first embodiment of the invention.
Figure 9A:
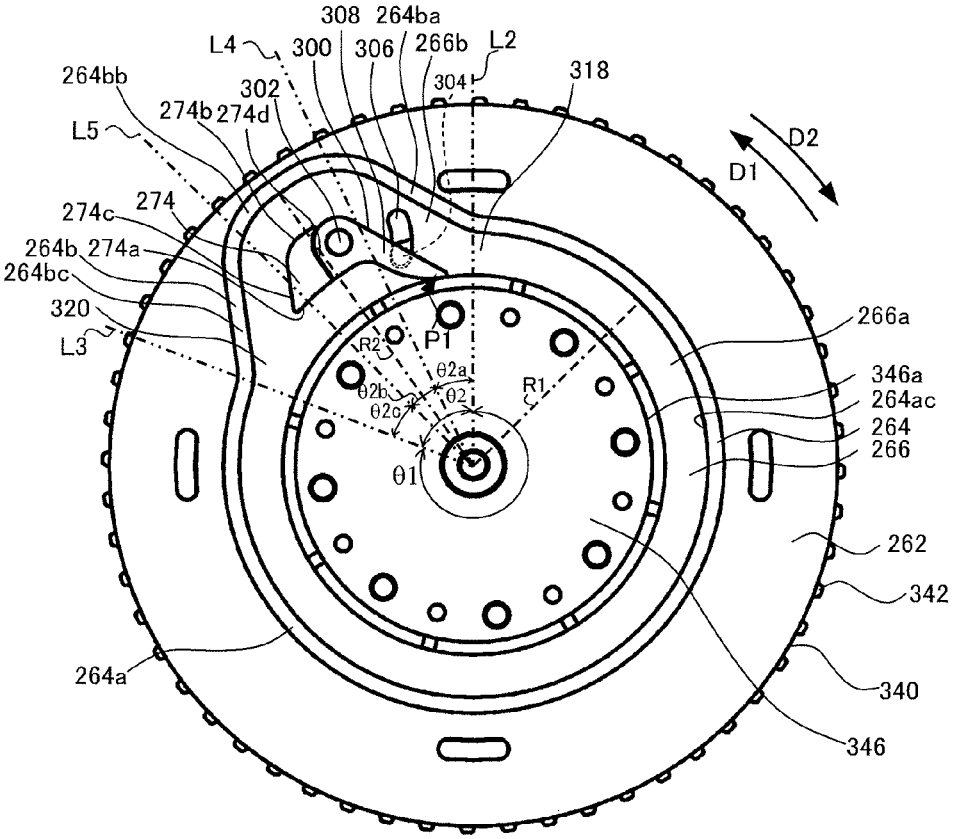
FIG. 9A is a front view of a cam device of the coin hopper of the first embodiment of the invention.
Figure 9B:
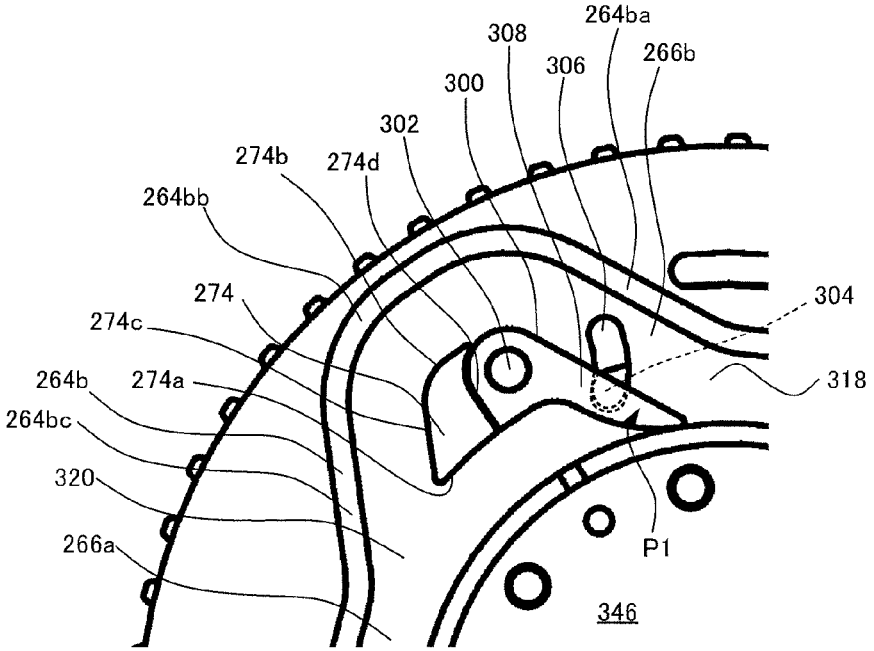
FIG. 9B is an enlarged front view of a route switching device of the cam device of the coin hopper of the first embodiment of the invention.
Figure 10A:
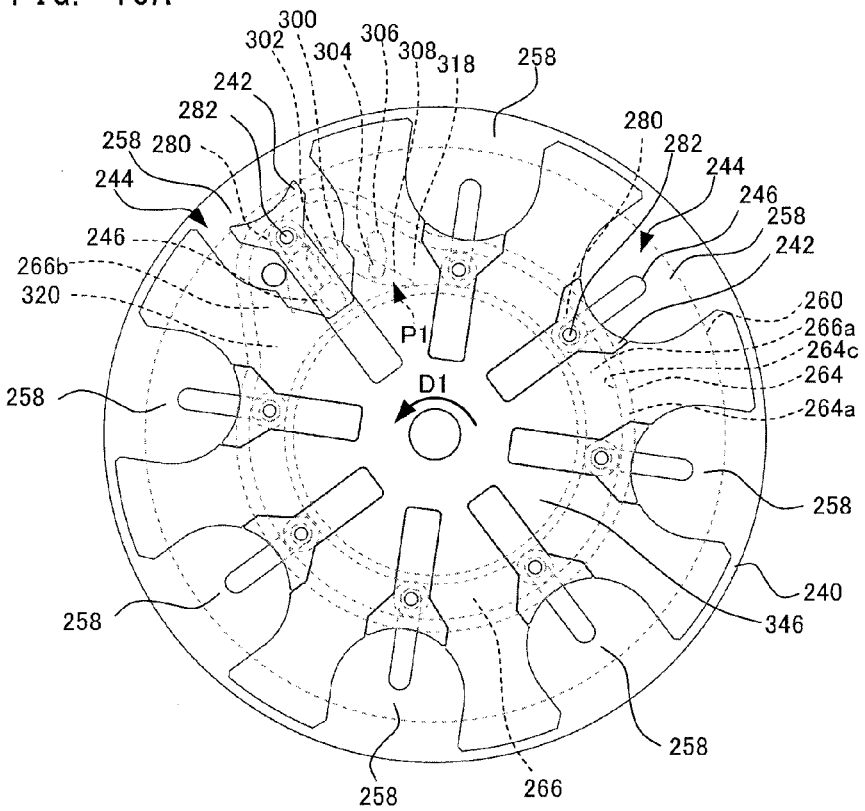
FIG. 10A is a front view illustrating a relationship between the coin holding portion and the cam device when a rotating disc of the coin hopper of the first embodiment of the invention rotates in a forward rotating direction.
Figure 10B:
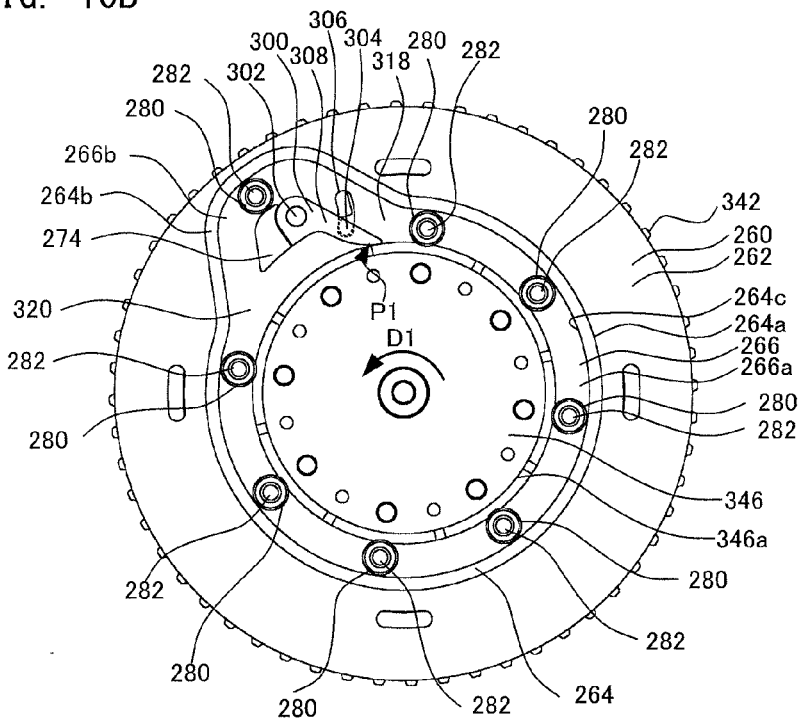
FIG. 10B is a front view corresponding to FIG. 10A illustrating a state in which the rotating disc is removed.
Figure 11A:
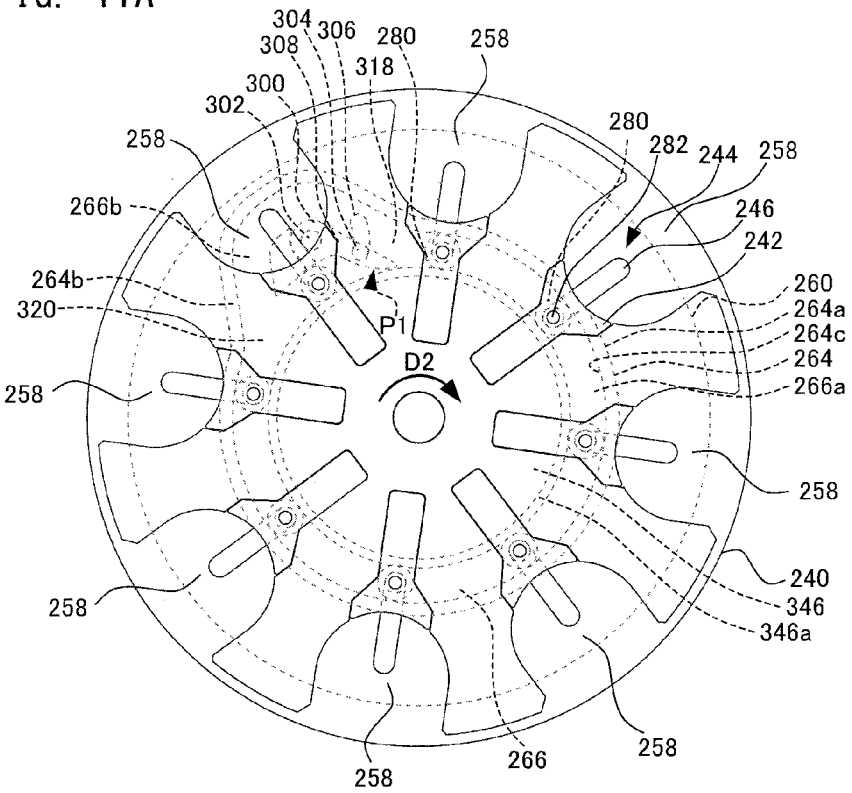
FIG. 11A is a front view illustrating the relationship between the coin holding portion and the cam device when the rotating disc of the coin hopper of the first embodiment of the invention rotates in a reverse rotating direction.
Figure 11B:
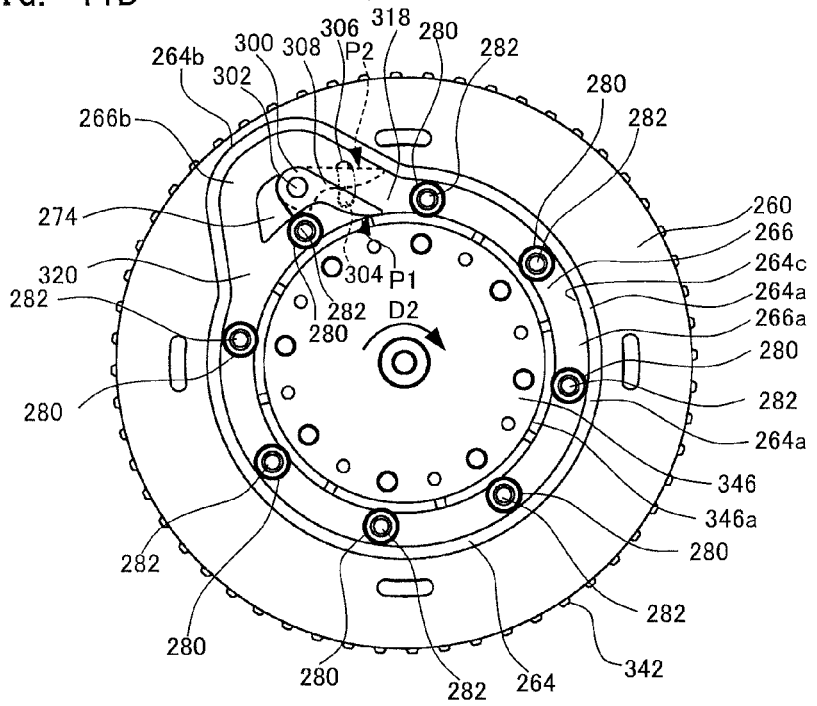
FIG. 11B is a front view corresponding to FIG. 11A illustrating a state in which the rotating disc is removed.

A surface of a coin C held in each recess 244 is supported by surface contact with each corresponding holding surface 256, and a peripheral surface thereof is supported by the side wall 248 and the side wall 250 of each recess 244, and the pushing surface 252 of each corresponding moving body 242, see FIG. 8. Each side wall 248 functions to push a peripheral surface of a coin C in the forward rotating direction D1 of the rotating disc 240. Each side wall 250 functions to push the peripheral surface of a coin C in the reverse rotating direction D2 of the rotating disc 240. The pushing surface 252 of each moving body 242 functions to push the peripheral surface of a coin C in the direction of diameter of the rotating disc 240, that is, to deliver the coin C from the rotating disc 240 to the next process.

Heights of each side wall 248 and each side wall 250 and a thickness of each moving body 242 are determined to be smaller than a thickness of a coin having the smallest thickness among coins C which are assumed to be used. Accordingly, each recess 244 holds only one coin and does not hold two or more coins C in a state of being stacked in a vertical direction on each holding surface 256. Therefore, each recess 244 functions to separate a plurality of kinds of coins different in thickness one by one.

A distance between each side wall 248 and each side wall 250 is determined to be larger than the diameter of a coin having the largest diameter among coins C which are assumed to be used, and to be smaller than twice the diameter of a coin having the smallest diameter. Accordingly, each recess 244 holds only one coin and does not hold two or more coins C in a state of being disposed side by side in the direction of rotation of the rotating disc 240. Therefore, each recess 244 functions to separate a plurality of kinds of coins different in outer diameter one by one.

When each moving body 242 is positioned at the coin holding position P3, a distance from the outer peripheral end of the disc body 254 to the pushing surface 252 of each moving body 242 is determined to be larger than a diameter of a coin having the largest diameter and to be smaller than twice a diameter of a coin having a smallest diameter among coins C which are assumed to be used. Accordingly, each recess 244 holds only one coin and does not hold two or more coins C in a state of being disposed side by side in the direction of the diameter of the rotating disc 240. Therefore, each recess 244 functions to separate a plurality of kinds of coins different in outer diameter one by one.

When each moving body 242 is positioned at the push-out position P4, the distance from the outer peripheral end of the disc body 254 to each pushing surface 252 of the moving body 242 is determined to be smaller than a diameter of a coin having the smallest diameter among coins C which are assumed to be used. Accordingly, part of the coin C is pushed out from the outer peripheral end of the disc body 254. Therefore, each recess 244 functions to deliver a plurality of kinds of coins different in outer diameter to the next process.

Cam Device

Referring now to FIG. 4, FIG. 5, FIG. 9A to FIG. 14B, the cam device 260 will be described below. The cam wheel 262 is disposed between the driven gear 340 and the disc body 254. The cam wheel 262 includes a substantially circular-shaped plate portion 262*a*, and a fixing portion 262*b* that fixes the cam wheel 262 to the first mounting portion 120*b* of the mounting base 120. The plate portion 262*a* of the cam wheel 262 is provided with a through hole 262*c*. The through hole 262*c* of the cam wheel 262 is larger than the projecting portion 346 of the driven gear 340. The cam wheel 262 is fixed to the first mounting portion 120*b* of the mounting base 120 with the projecting portion 346 of the driven gear 340 inserted into the through hole 262*c*. Accordingly, the plate portion 262*a* of the cam wheel 262 is disposed between the gear portion 342 of the driven gear 340 and the disc body 254 and the fixing portion 262*b* of the cam wheel 262 is fixed to the first mounting portion 120*b* of the mounting base 120.

The cam groove 266 is formed on a front surface of the plate portion 262*a* of the cam wheel 262 on the disc body 254 side. The cam groove 266 includes a substantially ellipsoidal-shaped first rib 264 formed on the surface of the plate portion 262*a*, the projecting portion 346 of the driven gear 340 inserted into the through hole 262*c*, and a second rib 274 formed between the first rib 264 and the projecting portion 346.

The first rib 264 includes a circular portion 264*a* having a radius R1, and a protruding portion 264*b* protruding from an circumference of the circular portion 264*a* toward an outer periphery of the plate portion 262*a* of the cam wheel 262. An inner peripheral surface 264*c* of the first rib 264 on the through hole 262*c* side has a relationship perpendicular with respect to the surface of the plate portion 262*a*. In a state illustrated in FIGS. 9A and 9B, the circular portion 264*a* is formed in a range of the angle θ1 from the straight line L2 in a direction of 0 o'clock to the straight line L3 (hereinafter, referred to as a range of the angle θ1) clockwise (in the reverse rotating direction D2 of the rotating disc) from the direction of 0 o'clock. In the state illustrated in FIGS. 9A and 9B, the protruding portion 264*b* is formed in a range of an angle θ2 from the straight line L2 in a direction of 0 o'clock to the straight line L3 (hereinafter, referred to as the range of the angle θ2) counterclockwise (the forward rotating direction D1 of the rotating disc) from the direction of 0 o'clock.

The center of the circular portion 264*a* of the first rib 264 is coaxial with a center of the through hole 262*c*, in other words, the axis of rotation L1 of the driven gear 340. The circular portion 264*a* has a length R1 (radius R1) from the axis of rotation L1, so that a distance between the inner peripheral surface 264*c* of the circular portion 264*a* of the first rib 264 and a peripheral surface 346*a* of the projecting portion 346 of the driven gear 340 inserted into the through hole 262*c* becomes larger than a diameter of the cam follower 280.

The protruding portion 264*b* of the first rib 264 is formed into a substantially isosceles trapezoidal shape. In the state illustrated in FIGS. 9A and 9B, the protruding portion 264*b* includes a first leg portion 264*ba* varying in distance from the axis of rotation L1 continuously from the length R1 to a length R2 in a range of an angle θ2*a* from the straight line L2 to the straight line L4 (hereinafter, referred to as a range of the angle θ2*a*) counterclockwise (the forward rotating direction D1 of the rotating disc 240) from the direction of 0 o'clock, an upper bottom portion 264*bb* maintaining a length R2 from the axis of rotation L1 in a range of an angle θ2*b* from the straight line L4 to the straight line L5 (hereinafter, referred to as a range of the angle θ2*b*), and a second leg portion 264*bc* varying in distance from the axis of rotation L1 continuously from the length R2 to the length R1 in a range of the angle θ2*c* from the straight line L5 to the straight line L3 (hereinafter, referred to as a range of the angle θ2*c*).

The second rib 274 is provided inside the protruding portion 264*b* of the first rib 264, in other words, between the protruding portion 264*b* and the through hole 262*c*. The second rib 274 has a substantially trapezoidal shape in plan view, and has a side surface having a relationship vertical to the surface of the plate portion 262*a*. The second rib 274 includes a first side surface 274*a* that faces the peripheral surface 346*a* of the projecting portion 346 of the driven gear 340, a second side surface 274*b* that faces the upper bottom portion 264*bb* of the protruding portion 264*b* of the first rib 264, a third side surface 274*c* that faces the second leg portion 264*bc* of the protruding portion 264*b* of the first rib 264, and a fourth side surface 274*d* substantially vertical to the first side surface 274*a* and to the second side surface 274*b*.

A distance of the first side surface 274*a* of the second rib 274 from the axis of rotation L1 is set to the length R1. The second side surface 274*b* of the second rib 274 is disposed at a distance larger than the diameter of the cam follower 280 from the upper bottom portion 264*bb* of the protruding portion 264*b* of the first rib 264. The third side surface 274*c* of the second rib 274 is disposed at a distance larger than the diameter of the cam follower 280 from the second leg portion 264*bc* of the protruding portion 264*b* of the first rib 264.

The cam groove 266 includes a first cam groove 266*a* provided over an entire circumference of the projecting portion 346 of the driven gear 340, and a second cam groove 266*b* provided at a position biased to an outer peripheral end of the rotating disc 240 with respect to the first cam groove 266*a* and connected to the first cam groove 266*a* at a first branch point 318 on the straight line L2 and at a second branch point 320 on the straight line L3. The first branch point 318 is provided with a route switching device 300 that switches a moving route of the cam follower 280 from the first cam groove 266*a* to the second cam groove 266*b* in a case where the rotating disc 240 rotates in the forward rotating direction D1.

The first cam groove 266*a* has a substantially circular shape. The projecting portion 346 of the driven gear 340 and the circular portion 264*a* of the first rib 264 constitute the range of the angle θ1 of the first cam groove 266*a*, and the projecting portion 346 and the first side surface 274*a* of the second rib 274 constitute the range of the angle θ2 of the first cam groove 266*a*. A distance between the peripheral surface 346*a* of the projecting portion 346 of the driven gear 340 and the inner peripheral surface 264*c* of the circular portion 264*a* of the first rib 264, and a distance between the peripheral surface 346*a* of the projecting portion 346 of the driven gear 340 and the first side surface 274*a* of the second rib 274 are larger than the diameter of the cam follower 280. Accordingly, the cam follower 280 disposed on the first cam groove 266*a* is allowed to move along the first cam groove 266*a*.

The second cam groove 266*b* has a substantially isosceles trapezoidal shape. The protruding portion 264*b* of the first rib 264, the second side surface 274*b* and the third side surface 274*c* of the second rib 274, and the route switching device 300 constitute the second cam groove 266*b*. Specifically, the first leg portion 264*ba* of the protruding portion 264*b* of the first rib 264 and the route switching device 300 constitute a range of the angle θ2*a*, the upper bottom portion 264*bb* of the protruding portion 264*b* of the first rib 264 and the second side surface 274*b* of the second rib 274 constitute a range of the angle θ2*b*, and the second leg portion 264*bc* of the protruding portion 264*b* of the first rib 264 and the third side surface 274*c* of the second rib 274 constitute a range of the angle θ2*c*. A distance between the first leg portion 264*ba* of the protruding portion 264*b* of the first rib 264 and the route switching device 300, a distance between the upper bottom portion 264*bb* of the protruding portion 264*b* of the first rib 264 and the second side surface 274*b* of the second rib 274, and a distance between the second leg portion 264*bc* of the protruding portion 264*b* of the first rib 264 and the third side surface 274*c* of the second rib 274 are larger than the diameter of the cam follower 280. Accordingly, the cam follower 280 disposed on the second cam groove 266*b* is allowed to move along the second cam groove 266*b*.

The route switching device 300 is disposed in the second rib 274 on the first branch point 318 side. In other words, the route switching device 300 is disposed in the second rib 274 on the fourth side surface 274*d* side. The route switching device 300 is displaceable between a waiting position P1 that blocks the first cam groove 266*a* and communicates the first cam groove 266*a* and the second cam groove 266*b* and a moved position P2 that opens the first cam groove 266*a* and blocks the communication between the first cam groove 266*a* and the second cam groove 266*b* at the first branch point 318.

The route switching device 300 is of a cantilevered flap type, and includes a valve shaft 302 that stands vertically with respect to the surface of the plate portion 262*a* of the cam wheel 262 (bottom surface of the second cam groove 266*b*), and a substantially plate-shaped valve element 308 that blocks the first cam groove 266*a* when positioned at the waiting position P1 and blocks the communication between the first cam groove 266*a* and the second cam groove 266*b* when positioned at the moved position P2. The valve element 308 is pivotably supported at one end by the valve shaft 302. When the valve element 308 is positioned at the waiting position P1, a side surface of the valve element 308 that faces the first leg portion 264*ba* of the protruding portion 264*b* of the first rib 264 extends substantially parallel to an inner peripheral surface of the first leg portion 264*ba*. In addition, when the valve element 308 is positioned at the waiting position P1, a distance between the first leg portion 264*ba* of the protruding portion 264*b* of the first rib 264 and the side surface of the valve element 308 that faces the first leg portion 264*ba* of the protruding portion 264*b* of the first rib 264 is larger than the diameter of the cam follower 280. The valve element 308 is configured in such a manner that an end portion of the valve element 308 opposite from the valve shaft 302 does not come into contact with the peripheral surface 346*a* of the projecting portion 346 of the driven gear 340 and a distance between the end and the peripheral surface 346*a* of the projecting portion 346 is smaller than the diameter of the cam follower 280 when the valve element 308 is positioned at the waiting position P1.

The valve element 308 is positioned at the waiting position P1 under its own weight when no external force is applied to the valve element 308. Therefore, when the rotating disc 240 rotates in the forward rotating direction D1, that is, when the cam follower 280 moves toward the forward rotating direction D1, the valve element 308 blocks the first cam groove 266*a* to prevent the cam follower 280 from entering the first cam groove 266*a* in the range of the angle θ2, and changes a moving route of the cam follower 280 from the first cam groove 266*a* to the second cam groove 266*b*. In contrast, when the rotating disc 240 rotates toward the reverse rotating direction D2, that is, when the cam follower 280 moves in the reverse rotating direction D2, the valve element 308 is pushed by the cam follower 280 that moves in the first cam groove 266*a* in the range of the angle θ2, and is displaced from the waiting position P1 to the moved position P2 with the valve shaft 302 as a supporting point. Accordingly, the blocking state of the first cam groove 266*a* is released and the cam follower 280 is allowed to pass through the route switching device 300, and the moving route of the cam follower 280 is maintained in the first cam groove 266*a*.

The valve element 308 is provided with the projection 304 projecting from a surface facing the bottom surface of the second cam groove 266*b* toward the bottom surface of the second cam groove 266*b*. The bottom surface of the second cam groove 266*b* is provided with an arcuate hole 306 at a position corresponding to the projection 304, and the projection 304 is inserted into the hole 306. When the valve element 308 is positioned at the waiting position P1, the projection 304 comes into contact with the end portion of the hole 306 on the through hole 262*c* of the hole 306 (the projecting portion 346 of the driven gear 340) side. In other words, the valve element 308 is stopped at the waiting position P1 by the projection 304 and the hole 306. Therefore, when the valve element 308 is positioned at the waiting position P1, the projection 304 and the hole 306 maintain the valve element 308 at the waiting position P1 even when a force that makes an attempt to move the valve element 308 from the moved position P2 to the waiting position P1 is applied.

In contrast, when the valve element 308 is positioned at the moved position P2, the projection 304 comes into contact with the end portion of the hole 306 on an opposite side of the through hole 262*c* of the hole 306. Accordingly, the valve element 308 is stopped at the moved position P2 by the projection 304 and the hole 306. Therefore, when the valve element 308 is positioned at the moved position P2, the projection 304 and the hole 306 maintain the valve element 308 at the moved position P2 even when a force that makes an attempt to move the valve element 308 from the waiting position P1 to the moved position P2 is applied.

Driving Device

The driving device 150 functions to drive the rotating disc 240 to rotate at a predetermined speed. The driving device 150 in the first embodiment includes a motor 152 and a decelerator 154. The decelerator 154 is fixed to the back side of the first mounting portion 120*b*, and an input gear of the decelerator 154 engages an output gear (not illustrated) of the motor 152 fixed to the decelerator 154. The output shaft (not illustrated) of the decelerator 154 penetrates through the first mounting portion 120*b*, and is fixed to a first drive gear 158. The first drive gear 158 is drivingly coupled to the gear portion 342 of the driven gear 340 of the rotating disc 240.

The driving device 150 has an overload preventing feature. In other words, in the case where the driving device 150 is overloaded by an abnormality such as coin jam, a current of an opposite polarity flows to the motor 152 by a control device, which is not illustrated, and the rotating disc 240 is rotated in the reverse rotating direction D2. Accordingly, when the abnormality such as coin jam is resolved and the loaded state of the driving device 150 becomes normal, the rotating disc 240 is rotated in the forward rotating direction D1 again by the control device.

Coin Dropping Device

Figure 6:
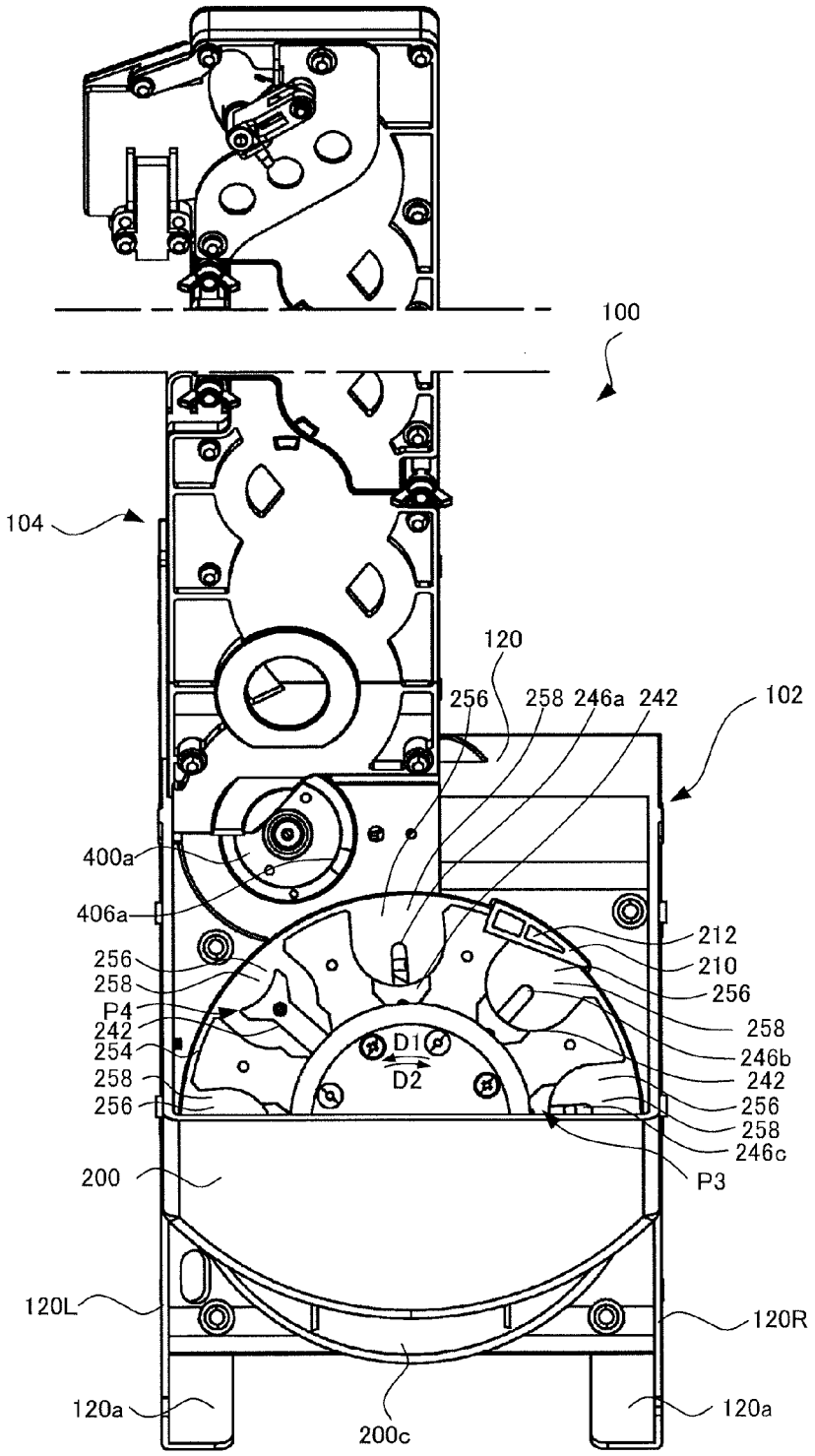
FIG. 6 is a front view illustrating the coin conveying and dispensing apparatus of the first embodiment of the invention.
Figure 7:
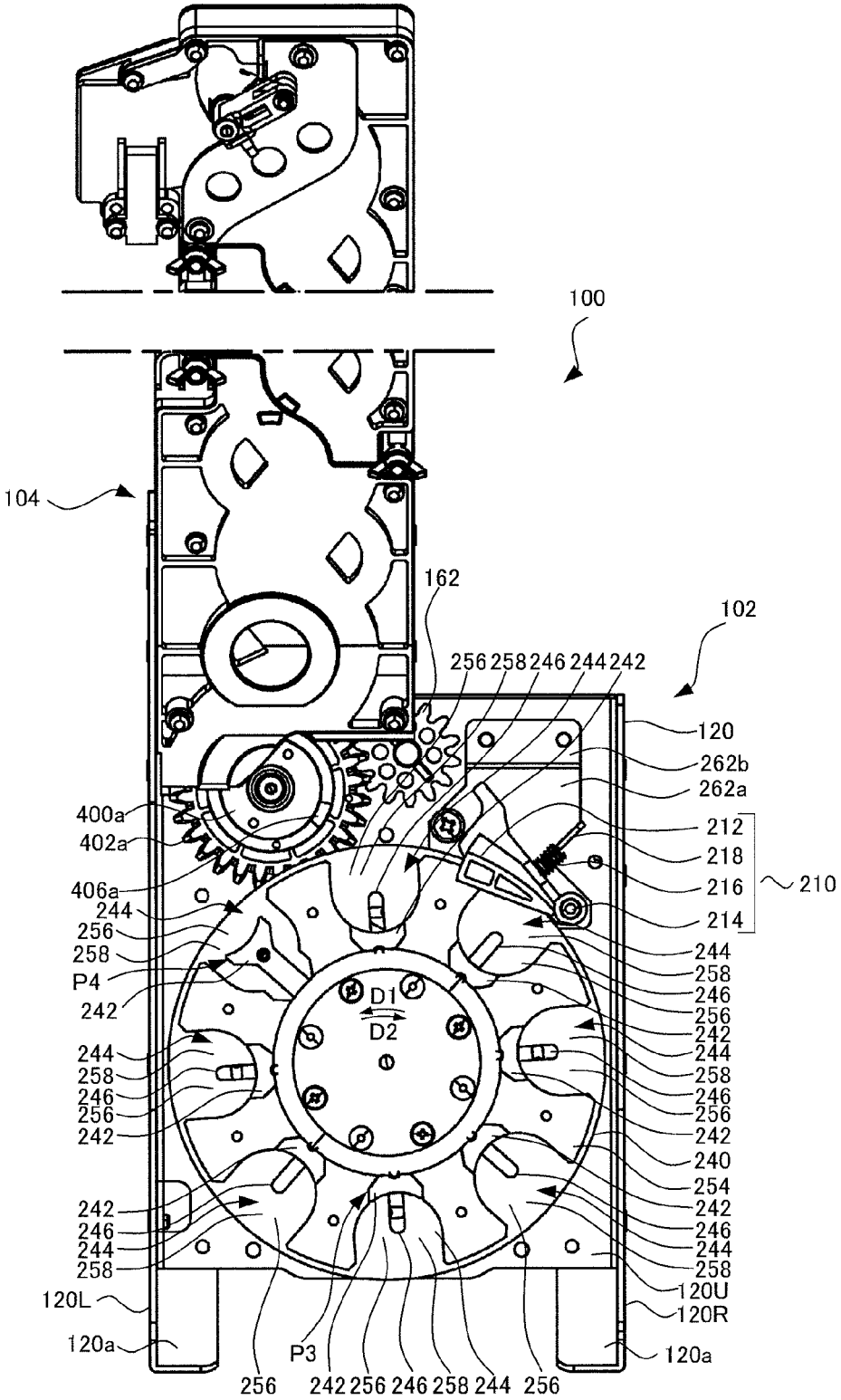
FIG. 7 is a front view of the coin conveying and dispensing apparatus of the first embodiment of the invention in which a coin tank is removed.

A coin dropping device 210 functions to cause a coin C placed on a coin C in contact with and held by the holding surface 256 to drop so that coins C are delivered to the coin conveying apparatus 104 in the next process one by one. The coin dropping device 210 is disposed above an axial line of the rotating disc 240 and disposed so as to face a peripheral edge of the rotating disc 240. In other words, the coin dropping device 210 is disposed approximately at a position of 2 o'clock with respect to the rotating disc 240 as illustrated in FIG. 6 and FIG. 7. The coin dropping device 210 is retractably movable in a plane in the proximity to and parallel to the holding surface 256 of the rotating disc 240.

The coin dropping device 210 includes a restricting member 212 that causes a coin C placed on a coin C in surface contact with and held by the holding surface 256 to drop, a rotating shaft 214 provided in the plate portion 262*a* of the cam wheel 262 to pivotably support the restricting member 212, a spring member 216 urging the restricting member 212 toward the rotating disc 240, and an engaging portion 218 provided on the plate portion 262*a* and engaging the spring member 216. The restricting member 212 is elastically movable retractably upward of the rotating disc 240. A distance between a bottom surface of the restricting member 212 and the holding surface 256 is slightly larger than the thickness of coins C having the largest thickness among coins C which are assumed to be used. Therefore, the restricting member 212 does not come into contact with a coin C which is in surface contact with the holding surface 256 and comes into abutment with a peripheral surface of a coin C placed on the coin C which is in surface contact with the holding surface 256. Accordingly, when coins C reach the coin dropping device 210 in a stacked manner, a movement of a coin C placed on the coin C which is in surface contact with the holding surface 256 in the forward rotating direction D1 of the rotating disc 240 is restricted, and only the coin C which is in surface contact with the holding surface 256 is conveyed in the forward rotating direction D1.

Coin Conveying Apparatus

Subsequently, the coin conveying apparatus 104 will be described. The coin conveying apparatus 104 functions to receive the coins delivered from the coin hopper 102, convey the received coins to predetermined dispensing positions, and dispense the conveyed coins one by one. The coin conveying apparatus 104 used here may be, for example, a coin conveying apparatus disclosed in the Japanese Patent No. 5732640.

Figure 15:
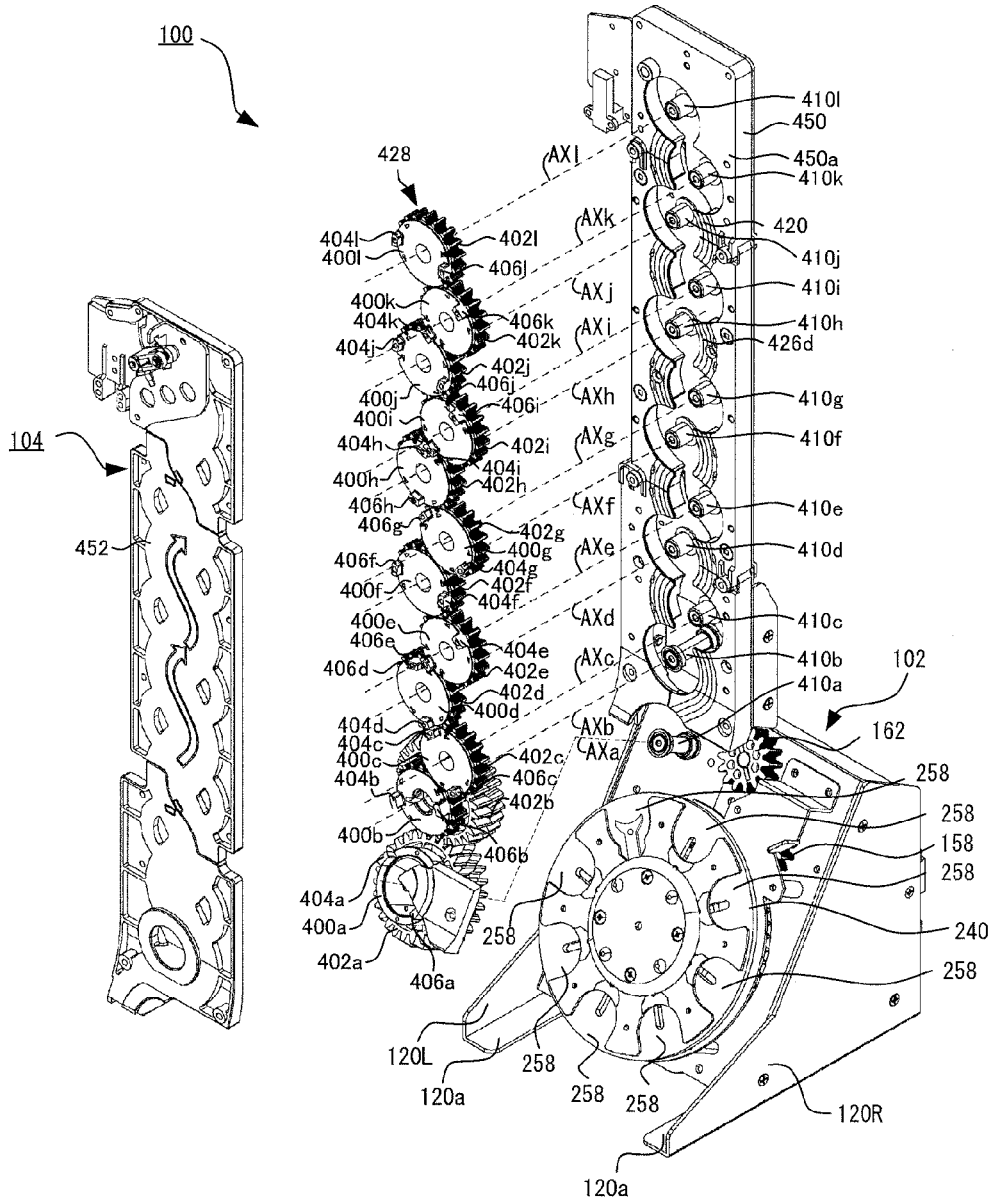
FIG. 15 is an exploded front perspective view illustrating the coin hopper of the coin conveying and dispensing apparatus of the first embodiment of the invention.
Figure 16:
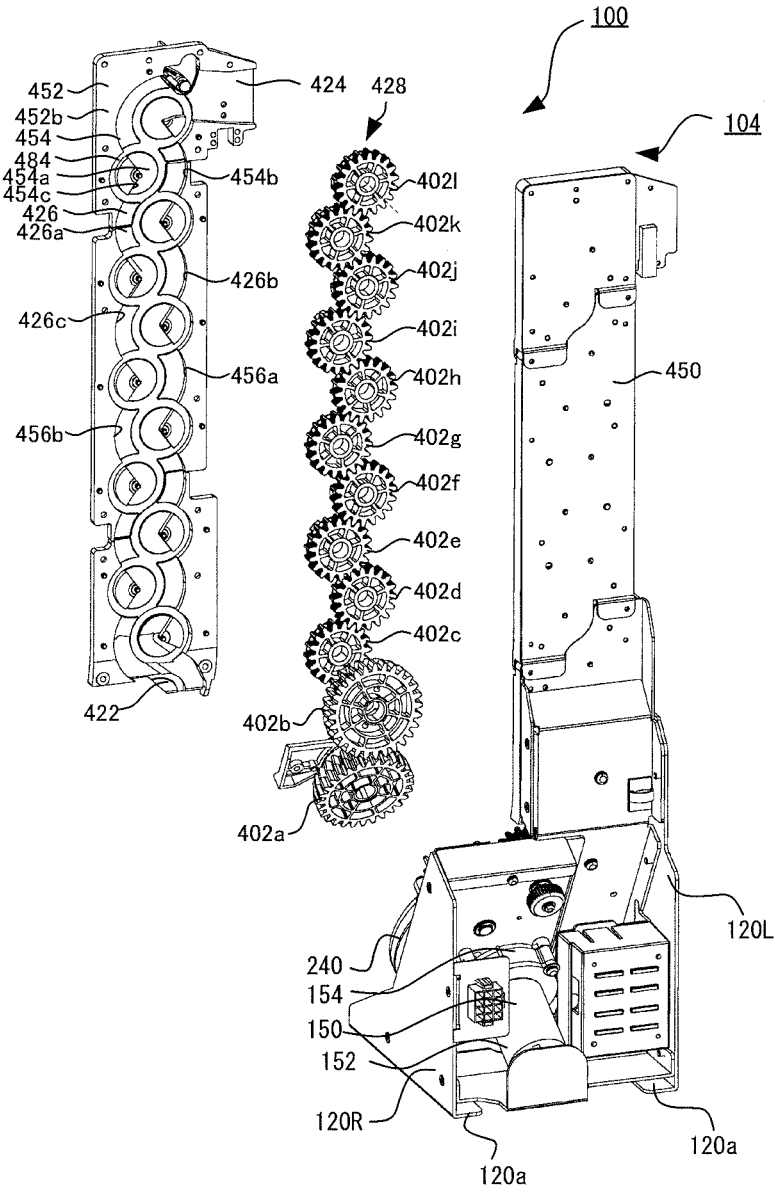
FIG. 16 is an exploded back perspective view illustrating the coin hopper of the coin conveying and dispensing apparatus of the first embodiment of the invention.

As illustrated in FIG. 15 and FIG. 16, the coin conveying apparatus 104 includes a coin guiding portion 420 having a coin guiding passage 426 that extends from a coin receiving port 422 to a coin outlet 424, and a coin pushing mechanism 428 having a plurality of rotating bodies 400*a* to 400*l* having first pushing bodies 404*a* to 404*l* and second pushing bodies 406*a* to 406*l*, respectively. As illustrated in FIG. 15 and FIG. 16, the coin guiding portion 420 includes a base body 450 and a top plate 452 provided on the base body 450.

The rotating body 400*a* is disposed on the upper surface 120U of the first mounting portion 120*b* of the mounting base 120 and is supported rotatably about an axis of rotation AXa which is perpendicular to the upper surface 120U. The rotating body 400*a* functions to receive coins C delivered from the coin hopper 102 one by one. The rotating bodies 400*b* to 400*l* are disposed on the base body 450 rotatably about axes of rotation AXb to AXl extending at a substantially right angle with respect to a surface 450*a* of the base body 450. The rotating bodies 400*b* to 400*l* are disposed with surfaces thereof in flush with the surface 450*a* of the base body 450. The two axes of rotation AX adjacent to each other among the axes of rotation AXb to AXl are offset from each other in a horizontal direction by a predetermined distance. In other words, a plurality of axes of rotation AXb to AXl are disposed in a zig-zag manner in a vertical direction as illustrated in FIG. 15.

A guiding groove 454 extends from the coin receiving port 422 to the coin outlet 424 on a back surface 452*b* side of the top plate 452. The guiding groove 454 includes a bottom surface 454*a*, and first and second side surfaces 454*b* and 454*c*, and the bottom surface 454*a* extends substantially at a right angle with respect to the axes of rotation AXb to AXl.

The guiding groove 454 has a width and a depth slightly larger than the diameter and the thickness of coin to be conveyed, respectively. In other words, the width and the depth of the guiding groove 454 allow the coins C being conveyed to pass in the interior of the guiding groove 454 while being guided by the bottom surface 454*a* and the first and second side surfaces 454*b* and 454*c*. When a plurality of kinds of coins having diameters and thicknesses different from each other are conveyed, the width and the depth of the guiding groove 454 correspond to the largest diameter and the largest thickness of the coin.

The first side surface 454*b* of the guiding groove 454 is formed along a curved line 456*a* defined by connecting a plurality of arcs having centers at the axes of rotation AXb, AXd, AXf, AXh, AXj, and AXl corresponding thereto. The second side surface 454*c* of the guiding groove 454 is formed along a curved line 456*b* defined by connecting a plurality of arcs having centers at the axes of rotation AXc, AXe, AXg, AXi, and AXk corresponding thereto.

Furthermore, annular grooves 484 that prevent contact of the pushing members 404*b* to 404*l* and 406*b* to 406*l* of the rotating bodies 400*b* to 400*l* with the top plate 452 when turning are formed on the back surface 452*b* of the top plate 452 corresponding to the axes of rotation AXb to AXl.

The coin guiding passage 426 is formed by the surface 450*a* of the base body 450, the bottom surface 454*a* of the guiding groove 454, and the first and second side surfaces 454*b* and 454*c* of the top plate 452. In other words, the surface 450*a* of the base body 450 functions as a back guiding surface 426*d* of the coin guiding passage 426. The bottom surface 454*a* of the guiding groove 454 of the top plate 452 functions as a front guiding surface 426*a* of the coin guiding passage 426. The first and second side surfaces 454*b* and 454*c* of the guiding groove 454 of the top plate 452 function as left and right guiding surfaces 426*b* and 426*c* of the coin guiding passage 426. A peripheral surface of a coin introduced from the coin receiving port 422 is guided by the left and right guiding surfaces 426*b* and 426*c* of the coin guiding passage 426 (that is, the first and second side surfaces 454*b* and 454*c* of the guiding groove 454) in the coin guiding passage 426. A surface and a back surface of a coin are guided by the front and back guiding surfaces 426*a* and 426*d* of the coin guiding passage 426 (that is, the bottom surface 454*a* of the guiding groove 454 and the surface 450*a* of the base body 450).

As illustrated in FIG. 15 and FIG. 16, the coin pushing mechanism 428 includes the rotating bodies 400*a* to 400*l* that are to be inserted into supporting shafts 410*a* to 410*l*, respectively. The rotating bodies 400*a* to 400*l* each have a substantially circular contour in plan view, and are supported by the corresponding supporting shafts 410*a* to 410*l* so as to be rotatable in both forward and reverse directions. In other words, the rotating bodies 400*a* to 400*l* are allowed to rotate about the corresponding axes of rotation AXa to AXl.

The rotating bodies 400*a* to 400*l* include pairs of first pushing bodies 404*a* to 404*l* and second pushing bodies 406*a* to 406*l* each having a trapezoidal shape which is bent along the outer periphery thereof in plan view and having a contour like a column projecting in a direction parallel to the axes of rotation AXa to AXl. In other words, the rotating body 400*a* is provided with the first and second pushing bodies 404*a* and 406*a* projecting from the surface of the rotating body 400*a* at an outer peripheral end thereof. The first and second pushing bodies 404*a* and 406*a* are disposed with the supporting shaft 410*a* interposed therebetween. In other words, the first and second pushing bodies 404*a* and 406*a* are disposed on a straight line orthogonal to the axis of rotation AXa on the rotating body 400*a*.

Regarding the rotating bodies 400*b* to 400*l*, the first and second pushing bodies 404*b* to 404*l* and 406*b* to 406*l* projecting from the surfaces of the rotating bodies 400*b* to 400*l*, respectively, are provided at peripheral edge portions of the rotating bodies 400*b* to 400*l* in the same manner as the rotating body 400*a*. The first and second pushing bodies 404*b* to 404*l* and 406*b* to 406*l* are disposed with the supporting shafts 410*b* to 410*l* interposed therebetween, respectively. In other words, the first and second pushing bodies 404*b* to 404*l* and 406*b* to 406*l* are disposed on straight lines orthogonal to the axes of rotation AXb to AXl on the rotating bodies 400*b* to 400*l*, respectively.

When the rotating bodies 400*a* to 400*l* rotate, the first and second pushing bodies 404*a* to 404*l* and 406*a* to 406*l* turn around the axes of rotation AXa to AXl, respectively.

The pushing bodies 404*a* to 404*l* and 406*a* to 406*l* each function to push coins C on substantially trapezoidal-shaped inclined surfaces. Therefore, with such a shape as described above in plan view, mechanical strength and durability against abrasion of the pushing bodies 404*a* to 404*l* and 406*a* to 406*l* may be enhanced. The pushing bodies 404*a* to 404*l* and 406*a* to 406*l* may be formed integrally with the corresponding rotating bodies 400*a* to 400*l*, and may be prepared as separate members and fixed to the rotating bodies 400*a* to 400*l* by a suitable method. In the first embodiment, these members are formed integrally from a cost reducing point of view. The pushing bodies 404*a* to 404*l* and 406*a* to 406*l* may have a cylindrical shape, or may be of a freely rotatable roller type formed by covering supporting shafts with cylindrical collars. The pushing bodies 404*a* to 404*l* and 406*a* to 406*l* of the roller type advantageously reduce abrasion of the pushing bodies 404*a* to 404*l* and 406*a* to 406*l* and enhance durability.

Gears 402*a* to 402*l* that drive the rotating bodies 400*a* to 400*l* to rotate respectively are provided coaxially on back surfaces of the rotating bodies 400*a* to 400*l*. The gears 402*a* to 402*l* and the rotating bodies 400*a* to 400*l* corresponding thereto are fixed to the corresponding supporting shafts 410*a* to 410*l*, respectively.

A second drive gear 162 that transmits a drive force of the motor 152 of the driving device 150 is drivingly coupled to the gear 402*a* of the rotating body 400*a*. The gear 402*a* is drivingly coupled to the gear 402*b* of the rotating body 400*b*. The gear 402*b* is drivingly coupled to the gear 402*a* and the gear 402*c*. The gears 402*c* to 402*l* are each drivingly coupled to the adjoining gears 402*b* to 402*l* in the same manner as the gears 402*a* and 402*b*.

Therefore, when the motor 152 is driven, a drive force of the motor 152 is transmitted to the gear 402*a* via the decelerator 154 and the second drive gear 162 to rotate the rotating body 400*a* and the gear 402*a*. Since the gears 402*a* to 402*l* are each drivingly coupled to the adjoining gears, the rotation of the gear 402*a* is transmitted sequentially to the gears 402*b* to 402*l*. In other words, the gears 402*b* to 402*l* function as driven gears. In this manner, the coin pushing mechanism 428 is driven and the rotating bodies 400*a* to 400*l* rotate, so that the first and second pushing bodies 404*a* to 404*l* and 406*a* to 406*l* are brought into a rotating motion. Accordingly, coins delivered from the coin hopper 102 one by one are delivered to the rotating body 400*a*, then are pushed by the first pushing bodies 404*a* to 404*l* and the second pushing bodies 406*a* to 406*l*, and then are conveyed in the coin guiding passage 426 from the coin receiving port 422 to the coin outlet 424.

Operation of Coin Delivery Device

The coin hopper 102 will be described below with reference to FIG. 10A to FIG. 14B. FIGS. 10A and 10B and FIGS. 12A to 12C illustrate a case where the rotating disc 240 rotates in the forward rotating direction D1, and FIGS. 11A and 11B, FIGS. 13A and 13B, and FIGS. 14A and 14B illustrate the case where the rotating disc 240 rotates in the reverse rotating direction D2.

The case where the rotating disc 240 rotates in the forward rotating direction D1 will be descried with reference to FIGS. 10A and 10B and FIGS. 12A to 12C. In a range of the angle θ1, the individual cam followers 280 move in the first cam groove 266*a*. Accordingly, the individual moving bodies 242 move in the forward rotating direction D1 in a state of being maintained at the coin holding position P3 in the range of the angle θ1. The individual coin holding portions 258 face coins C stored in bulk in the coin tank 200 and hold coins C that are brought into surface contact with the holding surfaces 256 of the recesses 244 of the coin holding portions 258 in the coin holding portions 258 (recesses 244) one by one in the course of moving in the range of the angle θ1. In addition, when the rotating disc 240 rotates in the forward rotating direction D1, the individual coin holding portions 258 move to the first branch point 318 of the cam groove 266 with the coins C held in the recesses 244.

Figure 12A:
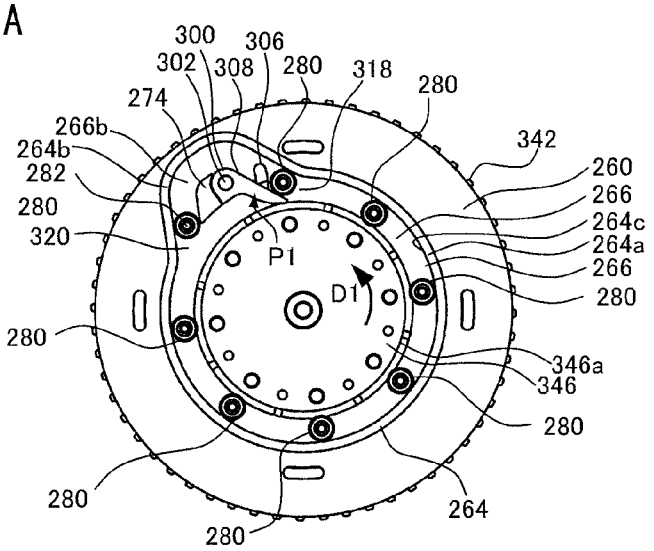
FIGS. 12A to 12C illustrate a state in which the rotating disc of the coin hopper of the first embodiment of the invention rotates in the forward rotating direction.
Figure 12B:
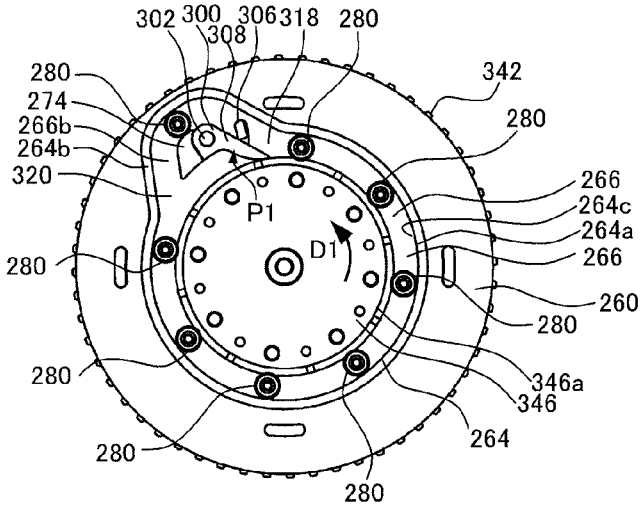
Figure 12C:
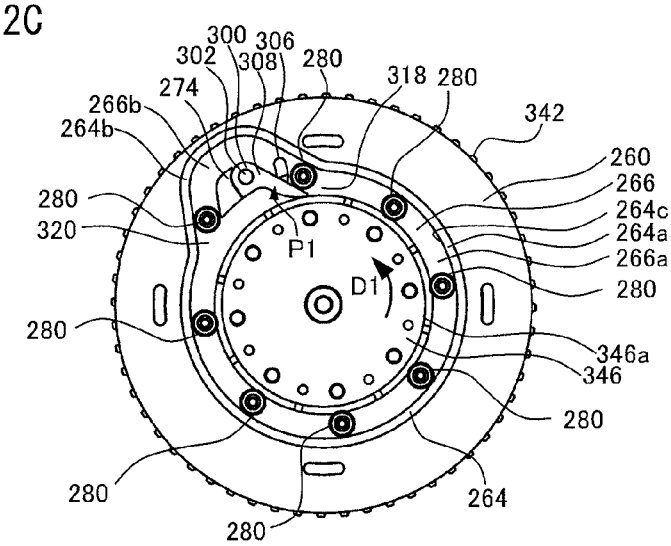
Figure 13A:
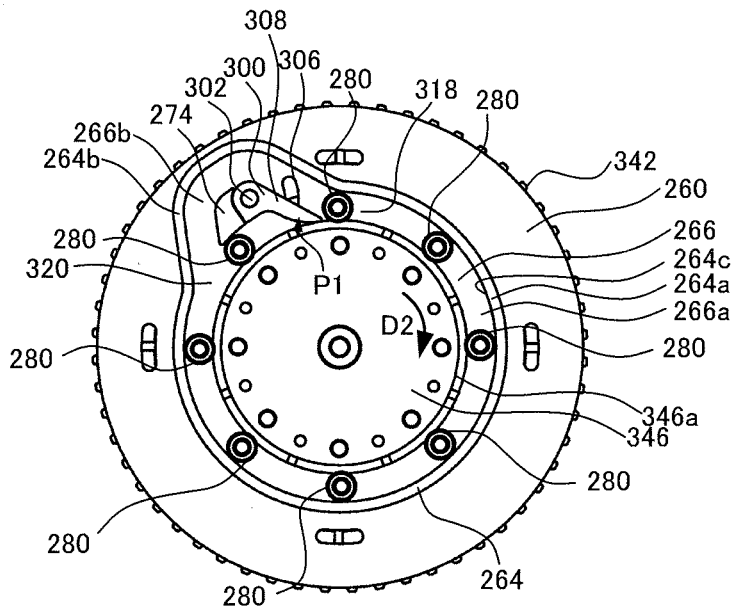
FIGS. 13A and 13B illustrate a state in which the rotating disc of the coin hopper of the first embodiment of the invention rotates in the reverse rotating direction.
Figure 13B:
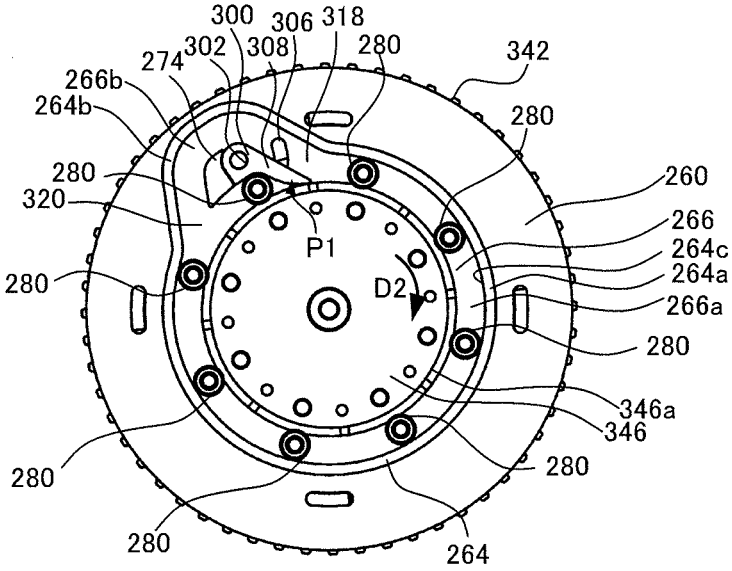
Figure 14A:
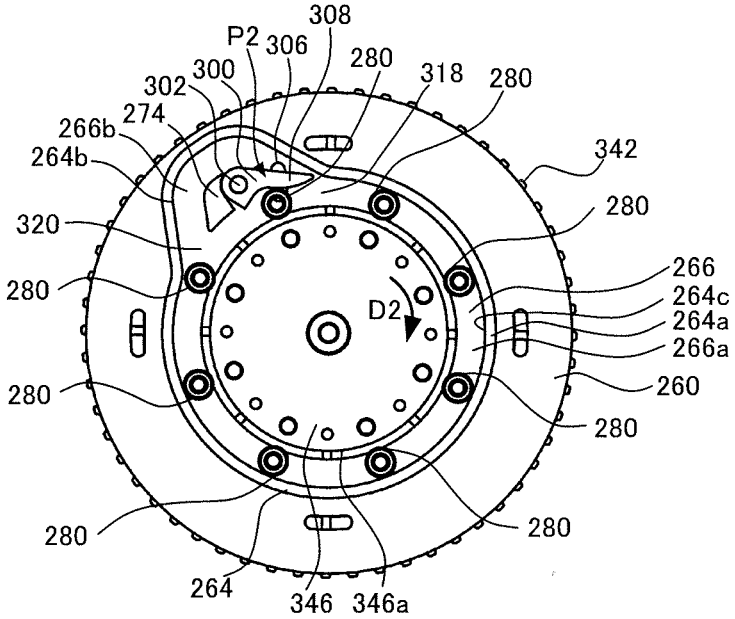
FIGS. 14A and 14B illustrate a state in which the rotating disc of the coin hopper of the first embodiment of the invention rotates in the reverse rotating direction.
Figure 14B:
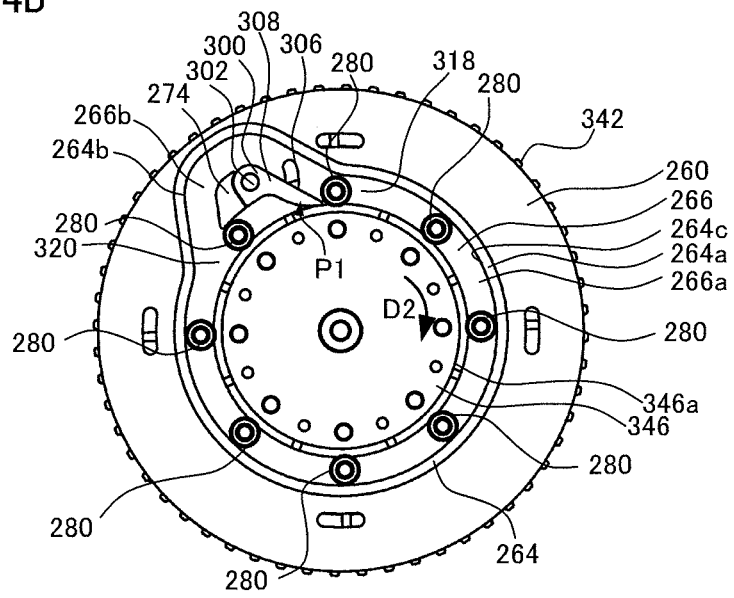

The route switching device 300 is positioned at the waiting position P1 under its own weight when no external force is applied thereto. Therefore, the route switching device 300 blocks the first cam groove 266*a* at the first branch point 318 and communicates the first cam groove 266*a* and the second cam groove 266*b*. Therefore, as illustrated in FIG. 12A, the individual cam followers 280 that have moved to the first branch point 318 in the first cam groove 266*a* within the range of the angle θ1 in the forward rotating direction D1 come into contact with the valve element 308 of the route switching device 300 at the first branch point 318, are prevented from approaching the first cam groove 266*a* in the range of the angle θ2, and then move from the first cam groove 266*a* to the second cam groove 266*b*.

In the range of the angle θ2*a*, the cam followers 280 that have moved to the second cam groove 266*b* move from the first branch point 318 toward the upper bottom portion 264*bb* of the protruding portion 264*b* of the first rib 264 by the valve element 308 of the route switching device 300. In other words, the cam followers 280 move toward the outer peripheral end of the disc body 254. Accordingly, the moving bodies 242 move from the coin holding position P3 toward the coin push-out position P4 in association with the movement of the corresponding cam follower 280 from the first branch point 318 to the upper bottom portion 264*bb*. Therefore, the coins C held in the recesses 244 of the individual coin holding portions 258 are pushed by the pushing surfaces 252 of the individual moving bodies 242 toward the outer peripheral end of the disc body 254.

After the individual cam followers 280 have moved to the upper bottom portion 264*bb* of the protruding portion 264*b* of the first rib 264 in the range of the angle θ2*a*, the individual cam followers 280 move along the upper bottom portion 264*bb* in the forward rotating direction D1 in the range of the angle θ2*b*. Therefore, the individual moving bodies 242 are maintained at the push-out position P4 in a range of the angle θ2*b*. Accordingly, the coins C are pushed by the side walls 248 of the individual recesses 244 in the forward rotating direction D1 in a state in which the coins C protrude partly outward from the outer peripheral end of the disc body 254 in the range of the angle θ2*b*. The coins C are delivered to one of the first and second pushing bodies 404*a* and 406*a* of the rotating body 400*a* of the coin conveying apparatus 104 in the next process while being pushed in the range of the angle θ2*b*.

In the range of the angle θ2*c*, the individual cam followers 280 are guided from the upper bottom portions 264*bb* of the projecting portions 264*b* of the first ribs 264 toward the second branch point 320 along the second leg portion 264*bc* of the protruding portion 264*b* of the first rib 264. Accordingly, the individual moving bodies 242 move from the push-out position P4 toward the coin holding position P3 in association with the movement of the corresponding cam followers 280 from the upper bottom portion 264*bb* to the second branch point 320.

In the range of the angle θ2*c*, after the individual cam followers 280 have moved from the upper bottom portion 264*bb* of the protruding portion 264*b* of the first rib 264 to the second branch point 320, the individual cam followers 280 move from the second cam groove 266*b* to the first cam groove 266*a* at the second branch point 320. Accordingly, after the individual moving bodies 242 have moved to the coin holding position P3 in the range of the angle θ2*c*, the individual moving bodies 242 are moved in the forward rotating direction D1 in the range of the angle θ1 in a state of being maintained at the coin holding position P3.

The case where the rotating disc 240 rotates in the reverse rotating direction D2 will be described below with reference to FIGS. 11A and 11B and FIGS. 13A to 14B. In a range of the angle θ1, the individual cam followers 280 move in the first cam groove 266*a* in the reverse rotating direction D2. Accordingly, the individual moving bodies 242 are moved in the reverse rotating direction D2 in a state of being maintained at the coin holding position P3 in the range of the angle θ1.

The second branch point 320 does not have the route switching device that switches the moving route of the cam followers 280 unlike the first branch point 318. Therefore, the moving route of the individual cam followers 280 is maintained in the first cam groove 266*a* without being switched from the first cam groove 266*a* to the second cam groove 266*b* at the second branch point 320. In other words, the individual cam followers 280 move from the first cam groove 266*a* in the range of the angle θ1 to the first cam groove 266*a* in the range of the angle 82. Accordingly, unlike the case where the rotating disc 240 rotates in the forward rotating direction D1, the individual moving bodies 242 are maintained at the coin holding position P3 in the range of the angle θ2. Subsequently, the individual cam followers 280 come into abutment with the valve element 308 of the route switching device 300 at the first branch point 318.

After the abutment of the individual cam followers 280 with the valve element 308 of the route switching device 300, when the rotating disc 240 further rotates in the reverse rotating direction D2, that is, when the individual cam followers 280 move in the reverse rotating direction D2, the valve element 308 is pushed by the cam followers 280 and the route switching device 300 is moved from the waiting position P1 toward the moved position P2. Accordingly, the first cam groove 266*a* in the range of the angle θ2 and the first cam groove 266*a* communicate with each other at the first branch point 318 and the individual cam followers 280 move from the first cam groove 266*a* in the range of the angle θ2 to the first cam groove 266*a*. Therefore, when the rotating disc 240 rotates in the reverse rotating direction D2, the individual moving bodies 242 move in the reverse rotating direction D2 in a state of being positioned at the coin holding position P3 in the range of the angle θ1 and in the range of the angle θ2. In other words, when the rotating disc 240 rotates in the reverse rotating direction D2, the individual moving bodies 242 move in the reverse rotating direction D2 in a state of being maintained at the holding position P3 and do not reciprocate between the holding position P3 and the push-out position P4.

If an abnormality such as coin jam occurs in the coin hopper 102 or the coin conveying apparatus 104 when the rotating disc 240 rotates in the forward rotating direction D1 in the coin conveying and dispensing apparatus 100 of the first embodiment, the rotating disc 240 rotates in the reverse rotating direction D2 in order to resolve the abnormality.

In the case where the rotating disc 240 rotates in the reverse rotating direction D2, a case where the individual cam followers 280 move in the second cam groove 266*b* in the range of the angle θ2, that is, the individual moving bodies 242 move from the holding position P3 toward the push-out position P4 like the case where the rotating disc 240 rotates in the forward rotating direction D1 will be described. Irrespective of the direction of rotation of the rotating disc 240, the individual moving bodies 242 are maintained at the holding position P3 in the range of the angle θ1. Therefore, even though the rotating disc 240 rotates in the reverse rotating direction D2, the individual coin holding portions 258 hold one coin C while the coin holding portions 258 move in the range of the angle θ1.

When the coin holding portions 258 move to the range of the angle θ2*c*, the moving route of the individual cam followers 280 is changed from the first cam groove 266*a* to the second cam groove 266*b*. Therefore, the individual moving bodies 242 are moved from the holding position P3 toward the push-out position P4. Accordingly, the individual moving bodies 242 push the coins C held in the coin holding portions 258 toward the outer peripheral end of the disc body 254. However, in the range of the angle θ2*c*, the recesses 244 of the coin holding portions 258 on the outer peripheral end side of the disc body 254 face the inner peripheral surface 200*e* of the supply port 200*d* of the coin tank 200. Therefore, even though the individual moving bodies 242 move from the holding position P3 toward the push-out position P4 in the range of the angle θ2*c*, the peripheral surfaces of the coins C on the opposite side from the individual moving bodies 242 come into contact with the inner peripheral surface 200*e*, and the individual moving bodies 242 are prevented from moving from the holding position P3 toward the push-out position P4. Accordingly, the pushing surfaces 252 of the individual moving bodies 242 and the inner peripheral surface 200*e* of the supply port 200*d* of the coin tank 200 hold the coins C from both sides. When the rotating disc 240 further rotates in the reverse rotating direction D2, the individual moving bodies 242, the inner peripheral surface 200*e* of the supply port 200*d* of the coin tank 200, and the coins C held between the individual moving bodies 242 and the inner peripheral surface 200*e* generate a braking force against the rotation of the rotating disc 240 in the reverse rotating direction D2. In other words, in the case where the rotating disc 240 rotates in the reverse rotating direction D2, an abnormality such as coin jam occurs, and the rotation of the rotating disc 240 in the reverse rotating direction D2 is impaired.

In contrast, a case where the individual cam followers 280 move in the first cam groove 266*a* in the range of the angle θ2, that is, the moving bodies 242 are maintained at the holding position P3 in the range of the angle θ2 when the rotating disc 240 having the configuration of the first embodiment rotates in the reverse rotating direction D2 will be described. Irrespective of the direction of rotation of the rotating disc 240, the individual moving bodies 242 are maintained at the coin holding position P3 in the range of the angle θ1. Therefore, even though the rotating disc 240 rotates in the reverse rotating direction D2, the individual coin holding portions 258 hold one coin C while the coin holding portions 258 move in the range of the angle θ1.

When the coin holding portions 258 move to the range of the angle θ2*c*, the individual cam followers 280 move in the first cam groove 266*a* in the range of the angle θ2, and the individual moving bodies 242 are maintained at the coin holding position P3. Therefore, the individual moving bodies 242 do not push the coins C held in the coin holding portions 258 toward the outer peripheral end of the disc body 254. Therefore, the coins C held by the coin holding portions 258 are not held between the pushing surfaces 252 of the individual moving bodies 242 and the inner peripheral surface 200*e* of the supply port 200*d* of the coin tank 200 from both sides and are pushed in the reverse rotating direction D2 in the range of the angle θ2. Therefore, the coins C, the individual moving bodies 242, and the inner peripheral surface 200*e* do not generate a braking force against the rotation of the rotating disc 240 toward the reverse rotating direction D2 of the rotating disc 240, and thus the rotations of the rotating disc 240 in the reverse rotating direction D2 are not impaired. Therefore, an abnormality such as coin jam may be resolved by the coin hopper 102 and the coin conveying apparatus 104 by rotating the rotating disc 240 in the reverse rotating direction D2.

Second Embodiment

Figure 17A:
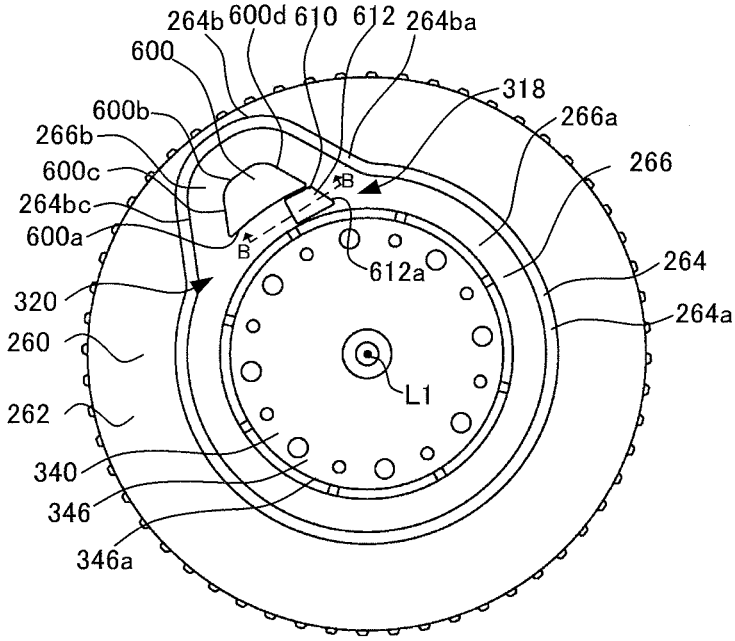
FIG. 17A is a front view of a route switching device of a coin hopper of a second embodiment of the invention.
Figure 17B:
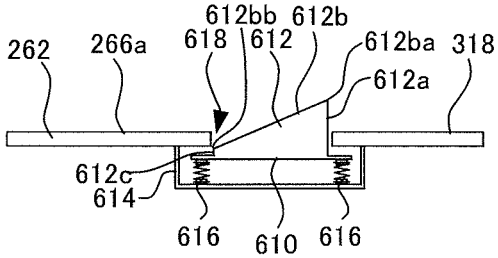
FIG. 17B is a cross-sectional view of the route switching device of the coin hopper of the second embodiment of the invention taken along a line B-B in FIG. 17A.

FIGS. 17A and 17B illustrate a cam device of the coin hopper 102 of the coin conveying and dispensing apparatus 100 according to a second embodiment of the invention. The coin conveying and dispensing apparatus 100 according to the second embodiment has the same configuration as the coin conveying and dispensing apparatus 100 according to the first embodiment described above except for points that a route switching device 610 includes a projecting strip 612 that is advanceable and retractable with respect to a bottom surface of the cam groove 266 instead of the valve element 308 provided rotatably about the valve shaft 302. The same members as those of the coin conveying and dispensing apparatus 100 according to the first embodiment described above are denoted by the same reference numerals.

In the second embodiment, a second rib 600 is formed into a substantially isosceles trapezoidal shape and includes first to fourth side surfaces 600*a*, 600*b*, 600*c*, and 600*d* facing respectively the peripheral surface 346*a* of the projecting portion 346 of the driven gear 340, the first leg portion 264*ba*, the upper bottom portion 264*bb*, and the second leg portion 264*bc* of the protruding portion 264*b* of the first rib 264.

A through hole 618 is provided in a bottom surface of the first cam groove 266*a* in the range of the angle θ2 in the vicinity of the first branch point 318 of the first cam groove 266*a* in the range of the angle θ2. The projecting strip 612 is inserted into the through hole 618 from the back side of the cam wheel 262. The route switching device 610 includes one or more urging members 616 urging the projecting strip 612 toward the interior of the first cam groove 266*a* in the range of the angle θ2 and an engaging portion 614 engaging the urging member 616 on the back side of the cam wheel 262, see FIG. 17B. Accordingly, the projecting strip 612 is elastically advanceable and retractable between the waiting position P1 at which the projecting strip 612 advances into the first cam groove 266*a* in the range of the angle θ2 and the moved position P2 at which the projecting strip 612 is retracted from the first cam groove 266*a* in the range of the angle θ2.

A projecting portion of the projecting strip 612 of the route switching device 610, which projects into the first cam groove 266*a* in the range of the angle θ2, has a substantially trapezoidal shape in plan view. The projecting portion of the projecting strip 612 includes a first side surface 612*a* that is substantially flush with the fourth side surface 600*d* of the second rib 600. The first side surface 612*a* moves the cam follower 280 from the first cam groove 266*a* to the second cam groove 266*b*.

The projecting portion of the projecting strip 612 includes an upper surface 612*b* inclining from an upstream side toward the downstream side of the forward rotating direction D1. An end portion 612*ba* of the upper surface 612*b* on the upstream side of the forward rotating direction D1 is connected to an upper end of the first side surface 612*a*. An end portion 612*bb* of the upper surface 612*b* on the downstream side of the forward rotating direction D1 is lower than a lower end portion of the cam follower 280. Accordingly, the cam follower 280 comes into abutment with the upper surface 612*b* without coming into contact with a second side surface 612*c* on the downstream side of the forward rotating direction D1 of the projecting strip 612. The upper surface 612*b* of the projecting strip 612 is pushed by the cam follower 280 that moves in the reverse rotating direction D2, and moves from the waiting position P1 to the moved position P2. When the cam follower 280 has passed above the projecting strip 612, the projecting strip 612 moves from the moved position P2 to the waiting position P1 by the urging member 616.

Modifications

The first embodiment and the second embodiment described above illustrate embodied examples of the invention. Therefore, the invention is not limited to these embodiments, and it is needless to say that various modifications are conceivable without departing from the scope of the invention. For example, in the above-described first embodiment, the valve element 308 of the route switching device 300 may be urged toward the waiting position P1 by using an urging member such as a spring. In the above-described second embodiment, the route switching device 610 may be disposed on the first side surface 274*a* of the second rib 274.

The invention is not limited to the above-described first and second embodiments and the above-described modifications, and includes other various modifications. For example, in the above-described first embodiment, the cam device 260 includes a groove cam (front cam) that guides the cam followers 280 in the cam groove 266. However, a plate cam (peripheral edge cam) that guides the cam followers on an outer peripheral surface of a plate-shaped cam is also applicable. The cam device 260 may include a rib cam having the cam followers disposed so as to pinch a plate-shaped rib formed on the cam wheel 262.

The invention may be used suitably for a coin handling apparatus that handles coins including hard money and medals, and suitably applied to coin changers, automatic vending machines, ticket vending machines, and game machines.

What is claimed is:

1. A coin hopper that separates coins in bulk one by one and delivers the coins individually comprising:

a rotating disc that is selectively rotatable in a first rotating direction and a second rotating direction, which is in a direction opposite to the first rotating direction;

a recess that is formed on a surface of the rotating disc, and extends from a central portion of the rotating disc toward an outer periphery of the rotating disc, opens at an outer peripheral end of the rotating disc, to receive and hold one of the coins;

a moving body that is disposed at a position corresponding to the recess, the moving body moving reciprocally between a coin holding position, which corresponds to a central portion of the rotating disc, the moving body forming a side portion of the recess and receives the coin in cooperation with the recess and the moving body can be moved to a coin push-out position, which corresponds to a position moved toward the outer periphery of the rotating disc, for pushing out the coin held in the recess toward the outer periphery of the rotating disc;

a cam wheel disposed on a back side of the rotating disc and provided with a cam groove having a predetermined shape on the rotating disc side; and a cam follower disposed in the cam groove provided on a back side of the moving body, wherein the cam groove includes a first route having a substantially circular shape and a second route connected to the first route at first and second branch points and protruding toward the outer periphery of the rotating disc with respect to the first route;

the moving body is held at the coin holding position when the cam follower moves along the first route and moves reciprocally between the coin holding position and the coin push-out position when the cam follower moves along the second route; and a route switching device is provided at the first branch point, and causes a moving route of the cam follower to be switched from the first route to the second route when the rotating disc rotates in the first rotating direction and the moving route of the cam follower to be maintained in the first route when the rotating disc rotates in the second rotating direction.

2. The coin hopper according to claim 1, wherein the route switching device includes a rotating shaft extending perpendicularly to a bottom surface of the cam groove and a valve element disposed rotatably about the rotating shaft, the valve element is switchable between a first position for blocking the first route and communicating the first route with the second route and a second position for blocking the communication between the first route and the second route and opening the first route, and the valve element is pushed from the first position toward the second position by the cam follower when the rotating disc rotates in the second rotating direction.

3. The coin hopper according to claim 2, wherein the valve element turns from the second position toward the first position under its own weight.

4. The coin hopper according to claim 2, wherein the valve element is urged by an urging member from the second position toward the first position.

5. The coin hopper according to claim 1, wherein the route switching device is elastically advanceable and retractable with respect to the first route and includes an inclined surface having a predetermined angle with respect to a bottom surface of the first route and inclined toward a downstream side of the first rotating direction, and the route switching device is retracted from the first route by being pushed on the inclined surface by the cam follower when the rotating disc rotates in the second rotating direction.

* * * * *